US007873293B2

(12) United States Patent
Omata

(10) Patent No.: US 7,873,293 B2
(45) Date of Patent: Jan. 18, 2011

(54) IMAGE HEATING APPARATUS AND HEATER FOR USE IN IMAGE HEATING APPARATUS

(75) Inventor: Masahito Omata, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/465,066

(22) Filed: May 13, 2009

(65) Prior Publication Data

US 2009/0220288 A1 Sep. 3, 2009

Related U.S. Application Data

(63) Continuation of application No. PCT/JP2008/072901, filed on Dec. 10, 2008.

(30) Foreign Application Priority Data

Dec. 13, 2007 (JP) ..... 2007-322076

(51) Int. Cl.
*G03G 15/20* (2006.01)

(52) U.S. Cl. ..... 399/69; 399/330; 399/334

(58) Field of Classification Search ..... 399/69, 399/328, 329, 330, 334; 219/216; 347/156
See application file for complete search history.

(56) References Cited

U.S. PATENT DOCUMENTS

| | | | | |
|---|---|---|---|---|
| 5,149,941 | A | 9/1992 | Hirabayashi et al. | 219/216 |
| 5,300,997 | A | 4/1994 | Hirabayashi et al. | 399/329 |
| 5,343,280 | A | 8/1994 | Hirabayashi et al. | 399/67 |
| 5,525,775 | A | 6/1996 | Setoriyama et al. | 219/216 |
| 5,767,484 | A | 6/1998 | Hirabayashi et al. | 219/216 |
| 6,084,208 | A * | 7/2000 | Okuda et al. | 219/216 |
| 7,203,438 | B2 | 4/2007 | Omata et al. | 399/69 |
| 2004/0091279 | A1 * | 5/2004 | Izawa et al. | 399/67 |
| 2005/0185994 | A1 * | 8/2005 | Inada et al. | 399/328 |
| 2006/0157464 | A1 | 7/2006 | Omata et al. | 219/216 |

FOREIGN PATENT DOCUMENTS

| | | |
|---|---|---|
| JP | 63-313182 | 12/1988 |
| JP | 4-44075 | 2/1992 |
| JP | 5-19652 | 1/1993 |
| JP | 7-325497 | 12/1995 |
| JP | 2002-55546 | 2/2002 |
| JP | 2003-84603 | 3/2003 |
| JP | 2005-234540 | 9/2005 |
| JP | 2007-25474 | 2/2007 |

OTHER PUBLICATIONS

Machine translation of JP 07-325497 A dated Nov. 11, 2009.*
Machine translation of JP 2002-055546 A dated Nov. 11, 2009.*
Machine translation of JP 2003-084603 A dated Nov. 11, 2009.*
Machine translation of JP 2007-025474 A dated Nov. 11, 2009.*
International Preliminary Report on Patentability in PCT/JP2008/072901, dated Aug. 19, 2010 (translation).

* cited by examiner

*Primary Examiner*—Sophia S Chen
(74) *Attorney, Agent, or Firm*—Fitzpatrick, Cella, Harper & Scinto

(57) ABSTRACT

The heater includes an elongated substrate, two electrodes disposed along a longitudinal direction of the substrate, and a heat generation resistive member connected between the two electrodes. The heat generation resistive member is formed on the substrate by one of a sputtering method and a vapor deposition method. The uniform heat generation distribution of a heat generation resistive member in a heater can be achieved so as to reduce a temperature difference between a pass-through area through which a recording material passes and a no sheet pass-through area through which the recording material does not pass.

11 Claims, 11 Drawing Sheets

IMAGE HEATING APPARATUS AND HEATER FOR USE IN IMAGE HEATING APPARATUS

CROSS-REFERENCE TO RELATED APPLICATIONS

This application is a continuation of International Application No. PCT/JP2008/072901, filed Dec. 10, 2008, which claims the benefit of Japanese Patent Application No. 2007-322076, filed Dec. 13, 2007.

BACKGROUND OF THE INVENTION

1. Field of the Invention

The present invention relates to an image heating apparatus suitable for use as an image heat fixing apparatus (fixer) mounted to an image forming apparatus such as an electrophotographic copying machine or an electrophotographic printer, and to a heater suitably used for the image heating apparatus.

2. Description of the Related Art

As an image heat fixing apparatus (fixer) to be mounted to an image forming apparatus such as an electrophotographic copying machine or a printer, there exists a film heating type apparatus. The film heating type fixing apparatus includes a heater having an electric heat generation member on a substrate made of a ceramic, a fixing film which moves while being in contact with the heater, and a pressure roller which forms a nip portion together with the heater through the fixing film. Japanese Patent Application Laid-Open Nos. S63-313182 and H04-044075 describe this type of fixing apparatus. A recording material bearing an unfixed toner image is heated while being pinched and conveyed at the nip portion of the fixing apparatus. As a result, the toner image formed on the recording material is fixed onto the recording material by heating. This fixer has an advantage in a short time required for raising temperature to a fixable temperature after starting energizing the heater. Therefore, a printer to which the fixer is mounted can reduce a "first printout time (FPOT)" corresponding to a time length required for outputting a first image after input of a print command. This type of fixer has another advantage in its low power consumption during a standby time for a print command.

Now, it is known that if a printer equipped with a fixer using a fixing film prints small size recording materials continuously at a print interval that is the same as that for large size recording materials, temperature of an area of a heater through which the recording materials do not pass (i.e., no sheet pass-through area) increases excessively. If temperature of the no sheet pass-through area of the heater increases excessively, a holder for holding the heater or a pressure roller may be damaged by heat. Therefore, the printer equipped with the fixer using the fixing film performs control to increase the print interval in the case of printing small size recording materials continuously compared with the case of printing large size recording materials continuously, so as to prevent temperature of the no sheet pass-through area of the heater from increasing excessively. However, the control of increasing the print interval reduces the number of sheets that can be output per unit time, and therefore it is desired to control the number of sheets that can be output per unit time to be almost the same or just a little smaller than that in the case of large size recording materials. Therefore, as the heater that is used for the above-mentioned fixer, two electrodes are provided to a heater substrate along the longitudinal direction of the heater substrate. Further, it is conceived to use the heater including a heat generation resistive member having a positive temperature coefficient (PTC) disposed between the two electrodes as described in Japanese Patent Application Laid-Open No. H05-019652, for example.

FIG. 15 illustrates an example of the heater. In FIG. 15, the heater includes a heater substrate 214, and electrodes 221 and 222. A feed power connector is connected to areas 221*a* and 222*a*. The two electrodes 221 and 222 are disposed along the longitudinal direction of the substrate 214. The heater includes a heat generation resistive member 215 as an electric heat generation member connected between the two electrodes 221 and 222. In addition, FIG. 16 is a circuit diagram electrically illustrating the heater of FIG. 15. As understood with reference to FIG. 16, the heater can be considered to have a structure in which an infinite number of resistors 215*r* are connected in parallel with each other between the two electrodes 221 and 222 (hereinafter, this type of heater is referred to as a pass-through direction energizing type).

As to the above-mentioned heater, if small size recording materials are driven to pass through the area through which large size recording materials pass (large size pass-through area D) for use in the printer, the no sheet pass-through area F is generated outside the area through which small size recording materials pass (small size pass-through area E). Temperature in the small size pass-through area E hardly rises because heat of the area is removed by the recording material. Therefore, a resistance value of the heat generation resistive member 215 in the small size pass-through area E is hardly increased so that power supply to the heat generation resistive member 215 in the small size pass-through area E is maintained. On the contrary, the resistance value of the heat generation resistive member 215 increases because of the temperature rise in the no sheet pass-through area F. Therefore, the current becomes reluctant to flow so that excessive temperature rise in the no sheet pass-through area F can be suppressed.

However, when the above-mentioned heater was actually incorporated in the fixer and was investigated, it was found that unevenness of heat generation distribution occurred in the heat generation resistive member in the longitudinal direction of the heater substrate despite that no recording material was driven to pass through. The reason of that was revealed to be in the resistance of the electrode. The two electrodes disposed along the longitudinal direction of the heater substrate have high conductivity, but a resistance value thereof is not zero. Therefore, the electrode itself causes a voltage drop due to its own resistance. Therefore, in spite of the state in which no recording material is driven to pass through, heat generation amount on the side close to the area contacting with the feed power connector (left side of the heat generation member of FIG. 10) becomes large while heat generation amount on the side far from the area (right side of the heat generation member of FIG. 10) becomes small. The inventor of the present invention proposes a unit for solving this technical problem in Japanese Patent Application Laid-Open No. 2005-234540.

SUMMARY OF THE INVENTION

A purpose of the invention is to provide a structure of a heater in which the heater described in Japanese Patent Application Laid-Open No. 2005-234540 can be manufactured more simply so as to solve the technical problem.

Another purpose of the invention is to provide an image heating apparatus including a heater including a substrate, a heat generation resistive member formed on the substrate, and a first electrode and a second electrode for feeding power to the heat generation resistive member; a backup member for forming a nip portion together with the heater; a control unit for controlling power to be fed to the heat generation resistive member so that temperature of the heater maintains a set temperature during an image heating process, wherein the image heats apparatus heating an image on a recording material at the nip portion, wherein: each of the first electrode and the second electrode includes a first area contacting with a feed power connector and a second area on an electrically opposite side of the first area; the second area is disposed along a longitudinal direction of the substrate; the heat generation resistive member is disposed so as to electrically connect the second area of the first electrode with the second area of the second electrode; and the heat generation resistive member is formed by one of a sputtering method and a vapor deposition method.

A further purpose of the invention is to provide a heater to be used in an image heating apparatus, including a substrate; a heat generation resistive member formed on the substrate; and a first electrode and a second electrode for feeding power to the heat generation resistive member, wherein: each of the first electrode and the second electrode includes a first area contacting with a feed power connector and a second area on an electrically opposite side of the first area; the second area is disposed along a longitudinal direction of the substrate; the heat generation resistive member is disposed so as to electrically connect the second area of the first electrode with the second area of the second electrode; and the heat generation resistive member is formed by one of a sputtering method and a vapor deposition method.

A still further purpose of the invention is to provide a heater that can equalize the heat generation distribution of the heat generation resistive member so that a temperature difference between the pass-through area through which recording materials pass and the no sheet pass-through area through which no recording material passes can be reduced, and an image heating apparatus having this heater. The present invention is described with reference to the drawings.

Further features of the present invention become apparent from the following description of exemplary embodiments with reference to the attached drawings.

DESCRIPTION OF THE EMBODIMENTS

First Embodiment

(1) Example of an Image Forming Apparatus

Figure 1:
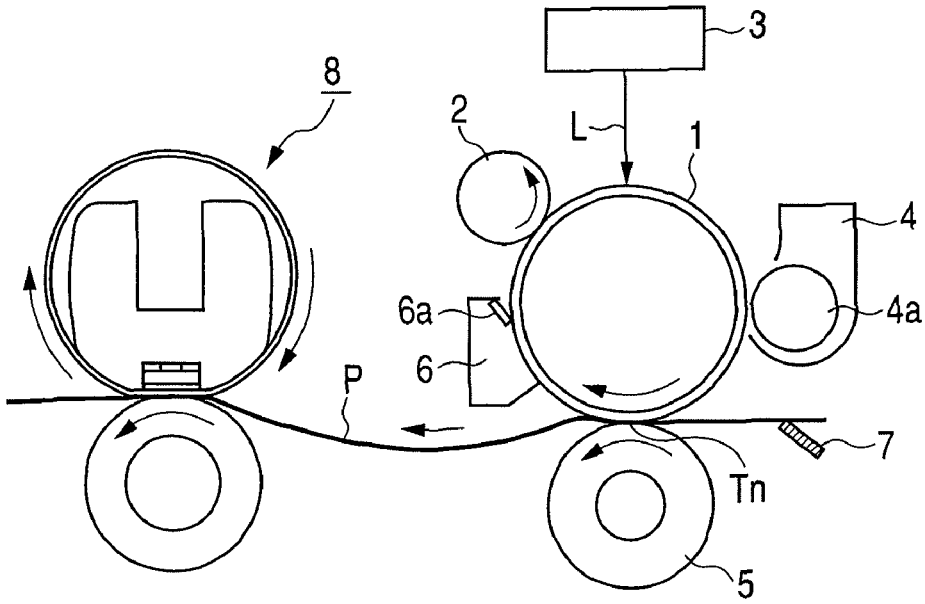
FIG. 1 is a model diagram illustrating a general structure of an example of an image forming apparatus.

FIG. 1 is a model diagram illustrating a general structure of an example of an image forming apparatus to which an image heating apparatus according to the present invention can be mounted as an image heat fixing apparatus. The image forming apparatus is a laser beam printer which forms an image on a recording material such as a plain paper, a thick paper, or a resin sheet by using electrophotographic image forming process. A maximum size of the recording material that can be used in this printer is a letter size (216 mm×279 mm). Further, this printer has a structure for conveying the letter size recording material in the state where a long side (279 mm) of the recording material is parallel with a recording material conveyance direction. In addition, a conveying reference of the recording material is a center in a longitudinal direction of a heater of an image heat fixing apparatus that is described later. The printer described in this embodiment includes a printer main body (not shown) constituting a cabinet of the printer (image forming apparatus main body) that houses a drum type electrophotography photosensitive member (hereinafter referred to as a photosensitive drum) 1 as an image bearing member. An outer diameter of the photosensitive drum 1 is approximately 24 mm. When a print instruction signal is entered from an external device such as a host computer, the photosensitive drum 1 is driven to rotate by a drive motor (not shown) in the direction of the arrow at a predetermined process speed. During the rotation operation of the photosensitive drum 1, a charging roller 2 as a primary electrifying unit electrifies a peripheral surface (outer surface) of the photosensitive drum 1 uniformly to have predetermined polarity and potential. Then, a laser beam scanning exposure device 3 as an exposure unit scans and exposes the electrified surface of the photosensitive drum 1 with a laser beam L. Thus, an electrostatic latent image (electrostatic image) is formed on the electrified surface of the photosensitive drum 1 according to target image information. A developing device 4 as a developing unit includes a developing roller 4*a*. When a developing bias is applied to the developing roller 4*a*, toner (developer) as developing agent is transferred from a peripheral surface (outer surface) of the developing roller 4*a* to the surface of the photosensitive drum 1. Thus, the latent image on the surface of the photosensitive drum 1 is visualized (developed) to be a toner image (developed image). A recording material P is fed from a paper feed mechanism (not shown) as a feed unit to a transferring nip portion Tn between the surface of the photosensitive drum 1 and a peripheral surface (outer surface) of a transferring roller 5 as a transferring unit. The recording material P is held and conveyed by the transferring nip portion Tn. In the conveying process, a transferring bias is applied to the transferring roller 5 so that the toner image on the surface of the photosensitive drum 1 is transferred onto the recording material P. The recording material P on which the toner image is transferred at the transferring nip portion Tn is separated from the surface of the photosensitive drum 1 and is conveyed to an image heat fixing apparatus 8. The fixing apparatus 8 performs heat-fixing process on the toner image, and the toner image is output as an image formation matter (copy or a printed matter). Application timings of the biases to be applied to the developing device 4 and the transferring roller 5 are controlled based on an ON/OFF signal of a sensor 7 (hereinafter referred to as a TOP sensor). In this embodiment, a photointerrupter is used as the TOP sensor. After the toner image is transferred onto the recording material P, the surface of the photosensitive drum 1 is cleaned by a cleaning blade 6*a* of a cleaning unit 6 so that residual accretion such as transfer residual toner is removed for repeating the image formation process.

(2) Fixing Apparatus

Image Heating Apparatus 8

Figure 2:
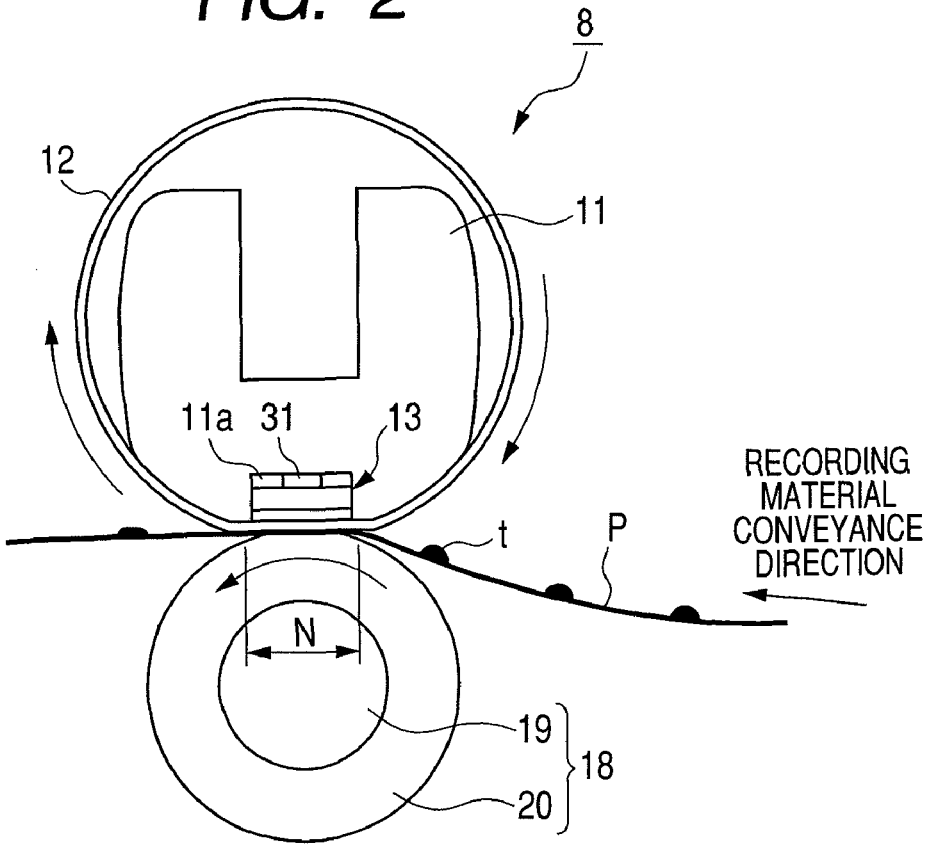
FIG. 2 is a model diagram illustrating a cross sectional side view of an example of a fixing apparatus.
Figure 3:
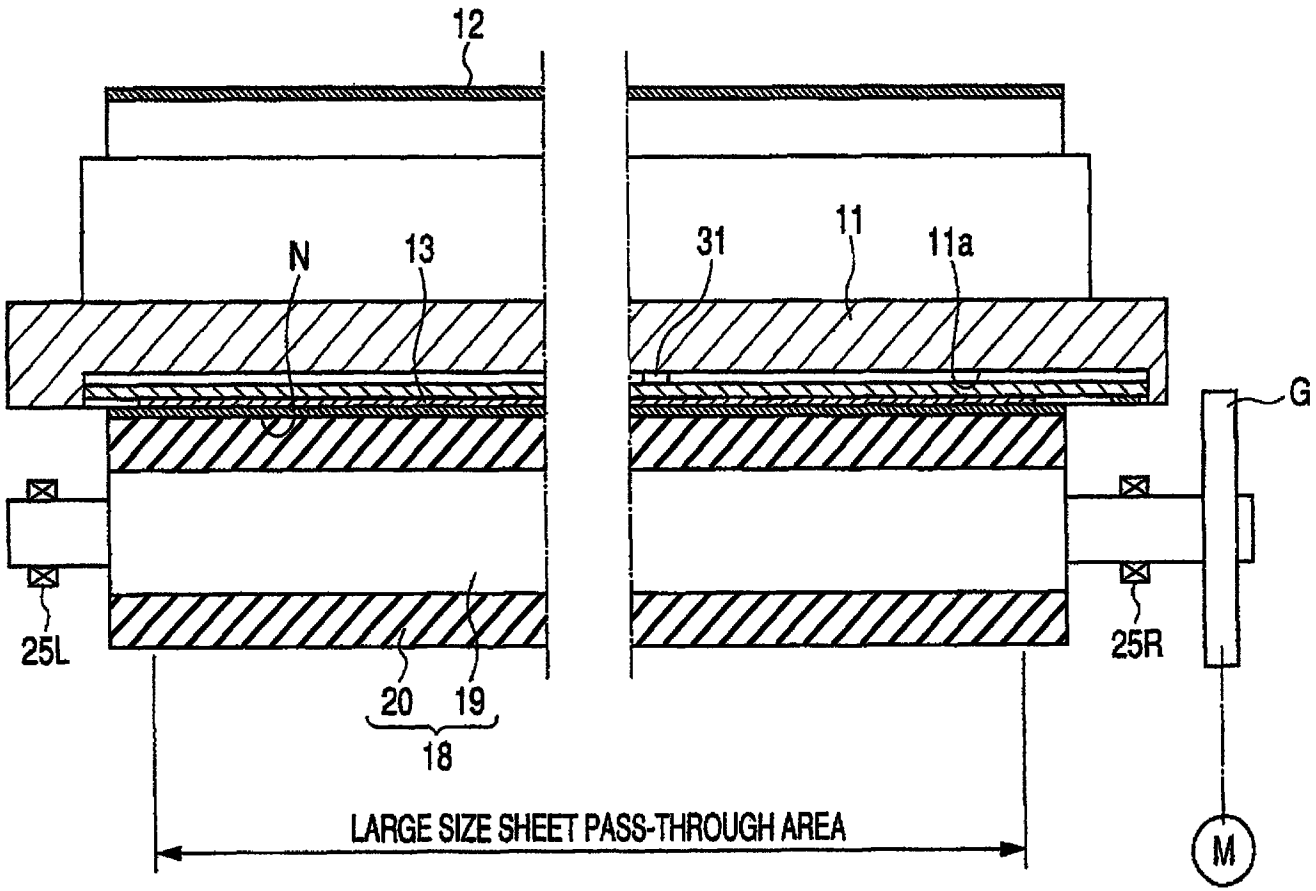
FIG. 3 is a model diagram illustrating a longitudinal sectional side view of the fixing apparatus.
Figure 4:
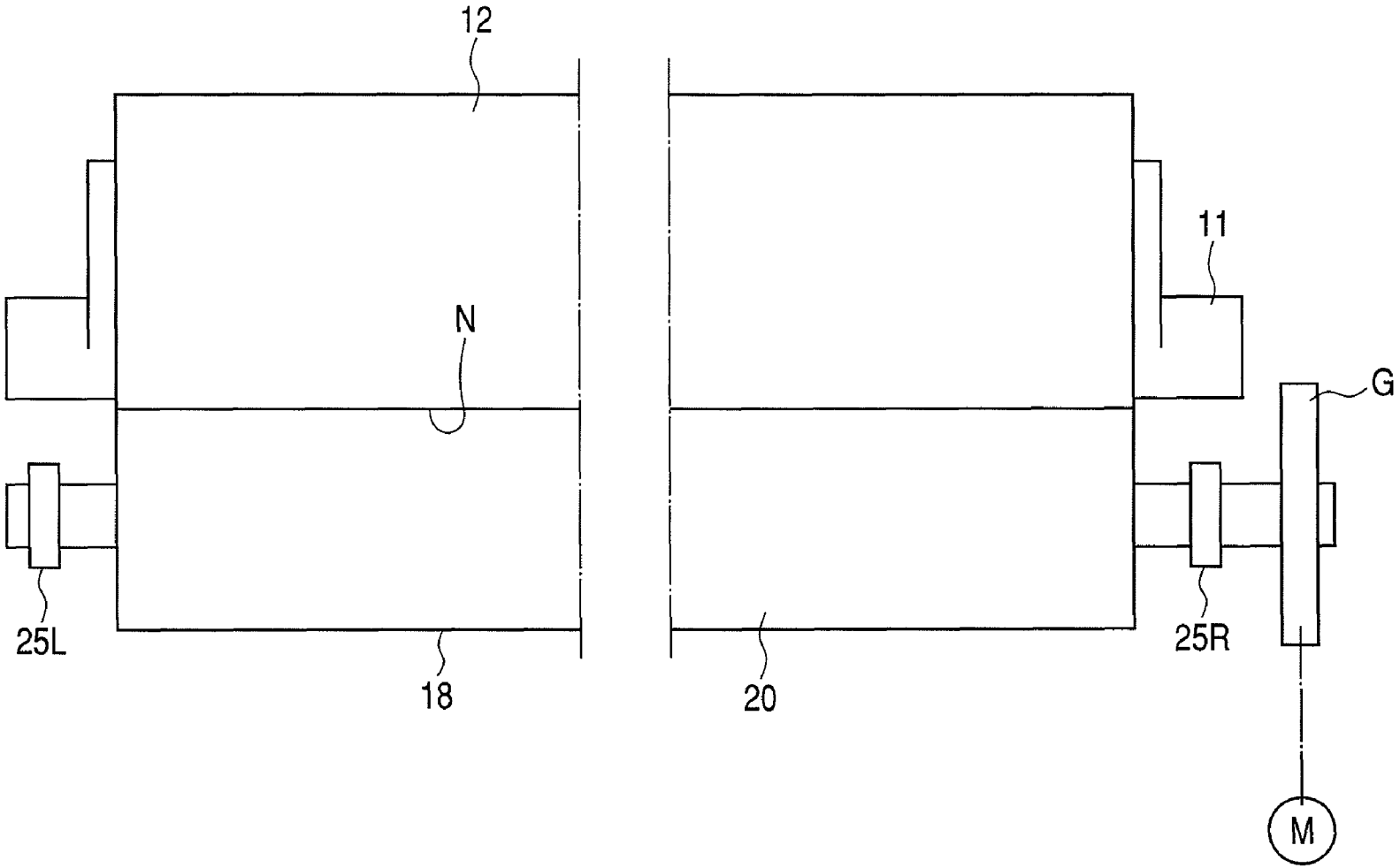
FIG. 4 is a diagram of the fixing apparatus viewed from a recording material input side.

FIG. 2 is a model diagram illustrating a cross sectional side view of an example of the fixing apparatus 8. FIG. 3 is a model diagram illustrating a longitudinal sectional side view of the fixing apparatus 8. FIG. 4 is a diagram of the fixing apparatus 8 viewed from a recording material input side. The fixing apparatus 8 is a tensionless type film heating image heating apparatus. In the following description, concerning the fixing apparatus or a member of the fixing apparatus, a longitudinal direction means a direction perpendicular to a recording material conveyance direction in the surface of the recording material. A short side direction means a direction parallel to the recording material conveyance direction in the surface of the recording material. A thickness direction means a direction perpendicular to the longitudinal direction and the short side direction. In addition, a length means a dimension in the longitudinal direction. A width means a dimension in the short side direction. A thickness or a film thickness means a dimension in the thickness direction. The fixing apparatus 8 illustrated in this embodiment includes a heater 13 as a heating member, a fixing film 12 as a flexible member, a stay 11 as a guide member, and a pressure roller 18 as a backup member. Each of the stay 11, the film 12, the heater 13 and the pressure roller 18 is elongated in the longitudinal direction.

1) Stay

The stay 11 is made of heat resistant resin material formed to have a cross section of a gutter shape. A groove 11*a* having a recess shape is provided to the stay 11 along the longitudinal direction in the middle in the width direction of a lower surface thereof, whereby the heater 13 is held in the groove 11*a*. The film 12 is made of heat resistant film formed in an endless shape (like a cylinder). Further, the film 12 engages with an outer surface of the stay 11. There is a relationship between an inner circumference of the film 12 and an outer circumference of the stay 11 that the former length is longer than the latter length by approximately 3 mm, for example. Therefore, the film 12 engages with the stay 11 loosely so as to have a margin in the circumference length. Further, end portions of the stay 11 are held by a pair of plates (not shown) of the apparatus.

2) Fixing Film (Flexible Sleeve)

The film 12 has a total thickness of approximately 40 to 100 microns so as to have a small thermal capacity for improving quick start performance. As a material of the film 12, it is possible to use a single layered film such as PI, PTFE, PFA or FEP having heat resistant, releasing property, strength, durability and the like. In addition, as a material of the film 12, it is possible to use a composite layered film in which an outer surface of polyimide, polyamidimid, PEEK, PES, PPS or the like is coated with PTFE, PFA, FEP or the like. The film 12 of this embodiment is the one including a coat layer made of fluorine resin such as PTFE or PFA with conductive additives formed on the outer surface of a polyimide film. However, the film 12 is not limited to this structure, but a simple tube made of a metal or the like may be used.

3) Pressure Roller

The pressure roller 18 includes a core shaft 19 made of aluminum, iron, stainless steel or the like and a heat-resistant rubber elastic layer (hereinafter referred to as an elastic layer) 20 that is formed on an outer surface of the core shaft 19 and is made of silicone rubber or the like having good releasing property. The pressure roller 18 has an outer diameter of 20 mm, and the elastic layer 20 has a thickness of 3 mm. In addition, a coat layer (not shown) in which fluorine resin is dispersed is formed on an outer surface of the elastic layer 20, whereby conveying performance of the recording material P and the film 12 is improved and contamination thereof due to the toner can be prevented. The pressure roller 18 disposed below the film 12 in parallel to the film 12 are held by the pair of plates of the apparatus in a rotatable manner via bearings 25L and 25R at both ends of the core shaft 19. The film 12 is pressed to the pressure roller 18 by a pressing unit (not shown) such as a pressure spring via the stay 11, and the elastic layer 20 of the pressure roller 18 is deformed elastically by the pressure. Thus, the pressure roller 18 and the heater 13 form a nip portion (fixing nip portion) N having a predetermined width for sandwiching the film 12 therebetween.

4) Heater

Figure 5:
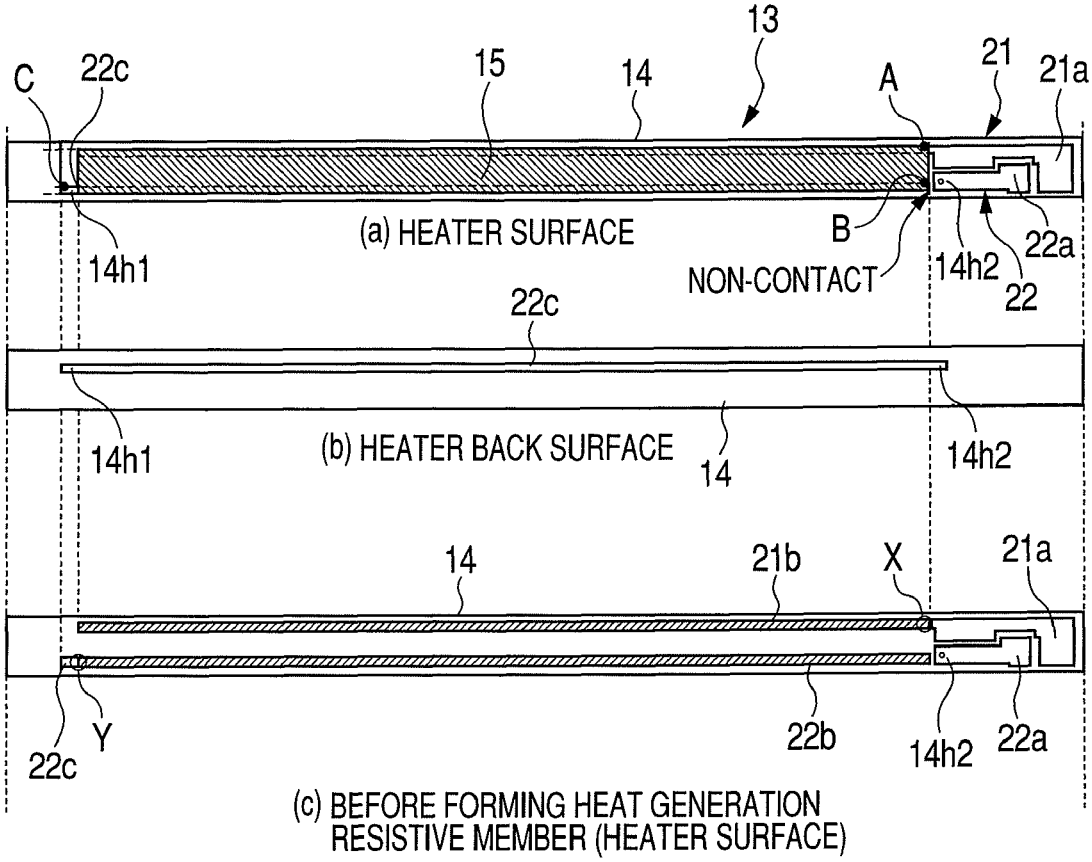
FIG. 5 is diagram illustrating an example of a heater according to a first embodiment of the present invention.

FIG. 5 diagram illustrating an example of the heater 13 according to this embodiment. (a) of FIG. 5 is an explanatory diagram illustrating a surface of the heater 13, (b) of FIG. 5 is an explanatory diagram illustrating a back surface of the heater 13, and (c) of FIG. 5 is an explanatory diagram illustrating an arrangement form of a first electrode 21 and a second electrode 22 before a heat generation resistive member 15 is formed on a substrate 14.

The substrate 14 is a heater substrate made of glass or ceramic that is elongated in the longitudinal direction and has good characteristics of heat resistance and insulation. A synthetic quartz substrate having a low thermal coefficient of expansion is used as the substrate 14 in this embodiment. The substrate 14 has dimensions of a length of approximately 270 mm, a width of 10 mm and a thickness of approximately 0.7 mm.

The first electrode 21 is disposed along the longitudinal direction of the substrate 14 on one end side in the short side direction of the substrate 14. The second electrode 22 is disposed along the longitudinal direction of the substrate 14 on the other end side in the short side direction of the substrate 14. Each of the electrodes 21 and 22 is made by a screen printing method of paste (electric conductor) made of a conductive material such as Ag or Ag/Pt with glass powder on the substrate 14. Volume resistance values of the electrodes 21 and 22 can be adjusted by changing a composition of the electric conductive material and the glass powder.

The electrode 21 is formed on the one end side in the short side direction of the substrate 14 (on an upstream side in the recording material conveyance direction). The electrode 21 includes a first area 21*a* for feeding power and a second area 21*b* for supplying power to the heat generation resistive member 15 (black thick line portion of (c) of FIG. 5) on the surface of the substrate 14 (surface on the side of the nip portion N). The first area 21*a* is disposed at the inside of one end portion (right end portion) in the longitudinal direction of the substrate 14. The second area 21*b* is connected to the first area 21*a* and is disposed to cover from the connection position to the inside of the other end portion (left end portion) along the longitudinal direction of the substrate 14. Further, the entire area in the longitudinal direction of the second area 21*b* is connected to the heat generation resistive member 15. The second area 21*b* is supplied with electric power from the first area 21*a*. Therefore, viewing the second area 21*b* from the first area 21*a* as the feed power side, the second area 21*b* is disposed at the inside of the end portion opposite to the first area 21*a* on the substrate 14. The second area 21*b* to be connected to the heat generation resistive member 15 is illustrated by the black thick line in (c) of FIG. 5, but a material of the second area 21*b* is the same as the material of the first area 21*a* in this embodiment. The same is true for the second electrode 22 described below.

The electrode 22 is formed on the other end side in the short side direction of the substrate 14 (on a downstream side in the recording material conveyance direction). The electrode 22 includes a first area 22*a* for feeding power, a second area 22*b* for supplying power to the heat generation resistive member 15 (black thick line portion of (c) of FIG. 5), and an extension area 22*c* for connecting the second area 22*b* with the first area 22*a*. The first area 22*a* is formed at the inside of one end portion (right end portion) in the longitudinal direction of the substrate 14 on the surface of the substrate 14. The second area 22*b* is formed so as to cover from the position separated from the first area 22*a* by a predetermined distance on the surface of the substrate 14 to the inside of the other end portion (left end portion) along the longitudinal direction of the substrate 14. Therefore, the second area 22*b* does not contact with the first area 22*a* on the surface of the substrate 14. In other words, the second area 22*b* is in non-contact with the first area 22*a*. Further, the entire area in the longitudinal direction of the second area 22*b* is connected to the heat generation resistive member 15. One end of the extension area 22*c* is connected to the second area 22*b* on the surface of the substrate 14. The other end of the extension area 22*c* is led out to the back surface of the substrate 14 (opposite side to the nip portion N) via paste filling in a through hole 14*h*1 formed in the substrate 14. The extension area 22*c* extends from the lead out position to the position corresponding to the first area 22*a* along the longitudinal direction of the substrate 14. Further, the other end of the extension area 22*c* is connected to the first area 22*a* via paste filling in a through hole 14*h*2 formed in the substrate 14. Therefore, the second area 22*b* is supplied with electric power from the first area 22*a* through the extension area 22*c*. Therefore, as to the electrode 22 too, viewing the second area 22*b* from the first area 22*a* as the feed power side, the second area 22*b* is disposed at the inside of the end portion opposite to the first area 22*a* on the substrate 14.

All the first areas 21*a* and 22*a* and the second areas 21*b* and 22*b* of the electrodes 21 and 22 may be made of the same material. Otherwise, the first areas 21*a* and 22*a* may be made of a material different from that of the second areas 21*b* and 22*b*. In this embodiment, the first areas 21*a* and 22*a* and the second areas 21*b* and 22*b* are made of the same material. In addition, the second areas 21*b* and 22*b* have a length of approximately 220 mm, a width of approximately 1 mm and a thickness of approximately a few tens of microns.

The heat generation resistive member 15 is formed on the surface of the substrate 14 along the longitudinal direction of the substrate 14. The heat generation resistive member 15 is made by forming a film of electric resistance material such as ruthenium oxide having the PTC characteristic on the substrate 14 using a screen printing method. Further, the heat generation resistive member 15 is printed on the electrodes 21 and 22 so as to electrically connect the second area 21*b* of the electrode 21 with the second area 22*b* of the electrode 22. A length of the heat generation resistive member 15 is set to be the same as the lengths of the second areas 21*b* and 22*b* of the electrodes 21 and 22. A volume resistance value of the heat generation resistive member 15 can also be adjusted by changing a composition of the electric resistance material.

A heater 13 of this embodiment has a structure for connecting the second areas 21*b* and 22*b* of the electrodes 21 and 22 via the heat generation resistive member 15. Therefore, the heater 13 can be regarded to have a structure in which an infinite number of resistors are connected in parallel to the recording material conveyance direction between the second area 21*b* of the electrode 21 and the second area 22*b* of the electrode 22 (pass-through direction energizing type). Here, concerning the electrodes 21 and 22, the second areas 21*b* and 22*b* mean areas in which a voltage drop is generated so as to affect the heat generation distribution of the heat generation resistive member 15. In other words, the area connected to the heat generation resistive member 15 (black thick line portion of (c) of FIG. 5) corresponds to the second areas. Therefore, the extension area 22*c* of the electrode 22 is not included in the second area 22*b*.

Figure 6A:
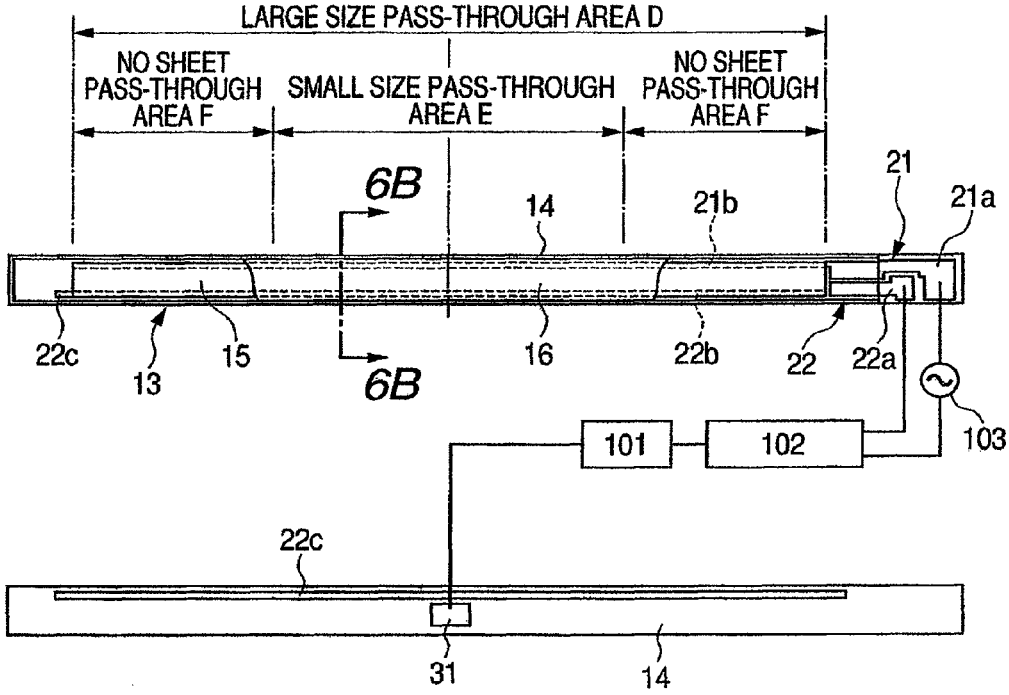
FIG. 6A is an explanatory diagram indicating a relationship between the heater and a temperature control system.
Figure 6B:
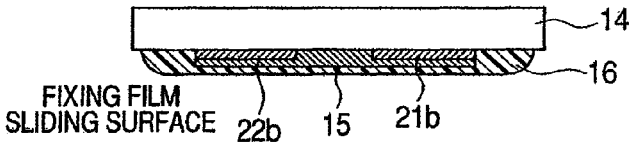
FIG. 6B is an enlarged cross section of FIG. 6A cut along the line 6B-6B.

In addition, the heater 13 of this embodiment is protected so that a part of the first areas 21*a* and 22*a* of the electrodes 21 and 22 as well as the heat generation resistive member 15 is covered with a protection layer 16 (FIGS. 6A and 6B). As the protection layer 16, glass, fluorine resin or the like is coated on the part of the first areas 21*a* and 22*a* as well as on the heat generation resistive member 15. Further, the heater 13 is held in the groove 11*a* of the stay 11 so that a surface of the protection layer 16 contacts with the inner circumference surface (inner surface) of the film 12.

5) Variation of the Heater of this Embodiment

In addition, as to the heater 13 illustrated in FIGS. 5A to 5C, a portion that is electrically closest to the first area 21*a* in the second area 21*b* of the electrode 21 (portion X illustrated in FIGS. 5C and 7) is disposed in a vicinity of one end portion (inside of the end portion) in the longitudinal direction of the substrate 14. In addition, a portion that is electrically closest to the first area 22*a* in the second area 22*b* of the electrode 22 (portion Y illustrated in FIGS. 5C and 7) is disposed in a vicinity of the other end portion (inside of the end portion) in the longitudinal direction of the substrate 14. In other words, as to both the heaters 13 illustrated in FIGS. 5A to 5C and 7, an inlet of current from the electrode 21 or 22 to the heat generation resistive member 15 is divided into both the end portions in the longitudinal direction of the substrate 14.

Figure 7:
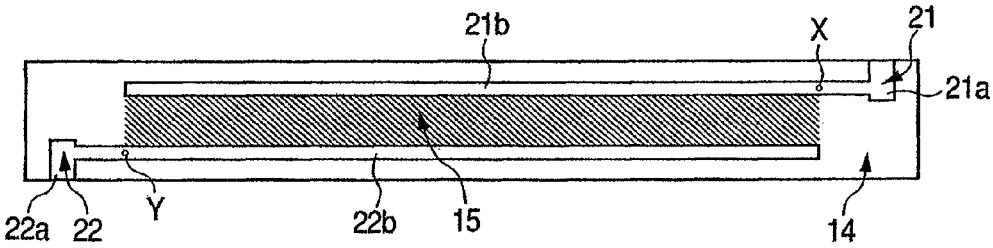
FIG. 7 is a diagram illustrating another example of the heater according to the first embodiment of the present invention.

In addition, as to the heater 13 illustrated in (a), (b) and (c) of FIG. 5, the first areas 21*a* and 22*a* of the electrodes 21 and 22 are disposed as a whole at the inside of one end portion of the substrate 14. Thus, a feed power connector, which is connected to the first areas 21*a* and 22*a*, for supplying power to the heater of the printer main body can be one unit so as to save space. In particular, if saving of space is not intended, another structure can be adopted in which the part (extension area 22*c*) of the electrode 22 may be disposed on the surface of the substrate 14 instead of the structure in which the through holes 14*h*1 and 14*h*2 are formed in the substrate 14, and the part 22*c* of the electrode 22 is disposed on the back surface of the substrate 14. In addition, it is possible to adopt another structure in which another one conductive path is formed along the longitudinal direction on the surface of the substrate 14 and is connected to the electrode 22, or another structure in which the feed power connector is connected to the electrodes 21 and 22 at both ends in the length direction of the substrate 14 as illustrated in FIG. 7. For simplifying the following description, the heater 13 having a pattern as described above concerning the electrodes 21 and 22 as well as the heat generation resistive member 15 is referred to as a "pass-through direction conductive pattern type".

(3) Heat-Fixing Operation of the Fixing Apparatus

FIG. 6A is an explanatory diagram illustrating a relationship between the heater 13 and a temperature control system, and FIG. 6B is an enlarged cross section of FIG. 6A cut along the line 6B-6B.

A drive gear G (FIG. 4) is provided to the end portion of the core shaft 19 of the pressure roller 18 and is driven to rotate by a fixing motor M, whereby the pressure roller 18 rotates in the arrow direction. When the pressure roller 18 is rotated, a moving force is exerted on the film 12 due to a friction force with the pressure roller 18 at the nip portion N. The moving force drives the film 12 to rotate as a follower in the arrow direction so that the inner surface of the film 12 contacts with (slides on) the surface of the protection layer 16 of the heater 13 at substantially the same speed as a peripheral speed of the pressure roller 18. While the film 12 is not rotating, almost the entire portion of substantially the entire circumference length of the film 12 except for the portion sandwiched between the heater 13 and the pressure roller 18 at the nip portion N is free from tension. When the film 12 rotates, a tension is exerted on the film 12 only at the nip portion N.

The film 12 is wound around the stay 11 with the margin and is driven to rotate in this way, and hence a pulling moving force in the longitudinal direction of the heater 13 when the film 12 rotates can be reduced, whereby it is possible to eliminate a pulling moving control unit for the film 12. In addition, it is possible to reduce drive torque so that the structure of the apparatus can be simplified and downsized, and cost thereof can be reduced.

A CPU 101 (FIG. 6A) as a control unit turns on a triac 102 as a current control element. Thus, electric power is fed from an AC power supply 103 via the feed power connector (not shown) disposed in the printer main body to the electrodes 21 and 22 of the heater 13. Further, the electric power is supplied between the second areas 21*b* and 22*b* of the electrodes 21 and 22 via the heat generation resistive member 15. Thus, the heat generation resistive member 15 generates heat so that the substrate 14 is heated, and the temperature of the entire heater 13 rises rapidly. The temperature of the substrate 14 heated corresponding to the temperature rise is sensed by a thermistor 31 as a temperature sensing unit disposed on the back surface of the substrate 14. The thermistor 31 is disposed in a vicinity of a recording material conveying reference portion (middle portion in the longitudinal direction of the heat generation resistive member 15) on the back surface of the heater 13 (surface opposite to the top surface of the heater 13 contacting with the inner circumference surface (inner surface) of the film 12), so as to secure stable fixing performance. The CPU 101 performs A/D conversion on an output signal of the thermistor 31 (sensed temperature) and fetches a result of the conversion. Further, based on the output signal of the thermistor 31, electric power supplied to the heater 13 is controlled by the triac 102 as phase control, frequency control or the like so that the temperature of the heater 13 is controlled. Specifically, the CPU 101 controls electric power supplied to the heater 13 so that the temperature sensed by the thermistor 31 maintains a set temperature (target temperature) during the heat-fixing process of a non-fixed toner image t born by the recording material P. More specifically, the temperature of the heater 13 is adjusted to be the set temperature by controlling electric power supplied to the heater 13 so as to increase the temperature of the heater 13 if the temperature sensed by the thermistor 31 is lower than a predetermined set temperature and to decrease the same if the sensed temperature is higher than the set temperature. The set temperature during the heat-fixing process is set by the CPU 101 according to a warming degree of the pressure roller 18, a type of the recording material P (plain paper, thick paper, resin sheet or the like), and the like. The warming degree of the pressure roller 18 can be estimated by counting the number of prints in case of continuous print or by counting the time period of the continuous print. Therefore, the printer of this embodiment has multiple set temperatures corresponding to types of the recording material P, and performs control of changing the set temperature according to the warming degree of the pressure roller 18, the type of the recording material P, or the like.

Thus, the recording material P bearing the non-fixed toner image t is led into the nip portion N with the toner image bearing side being upward in the state where the pressure roller 18 and the film 12 are rotating and the heater 13 is supplied with electric power. The recording material P is held and conveyed by the nip portion N together with the film 12, and thermal energy of the heater 13 contacting with the inner surface of the film 12 at the nip portion N is given to the recording material P via the film 12 so that heat and press fixing of the toner image t is performed by the pressure at the nip portion N.

Figure 8:
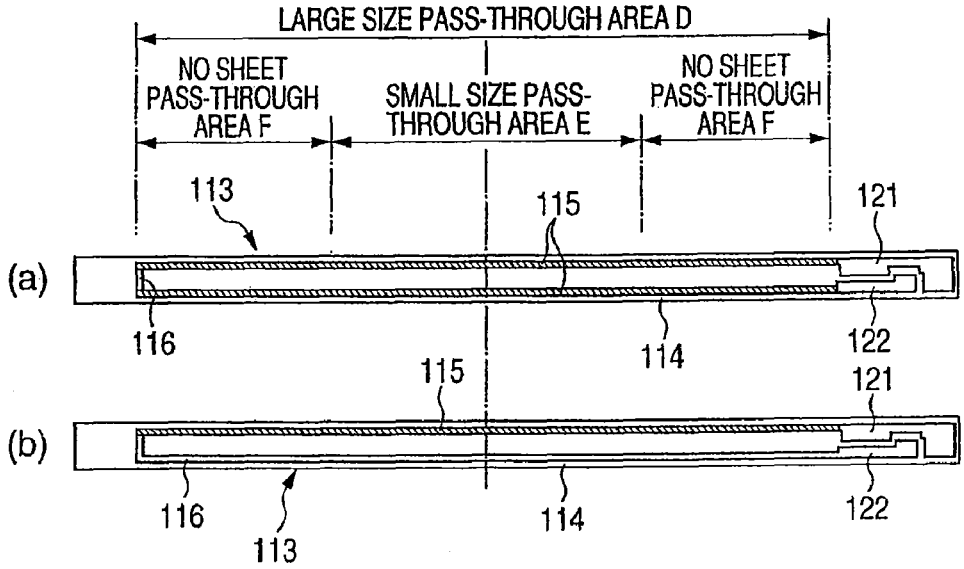
FIG. 8 PRIOR ART
FIG. 8 is diagram illustrating an example of a conventional heater.
Figure 9:
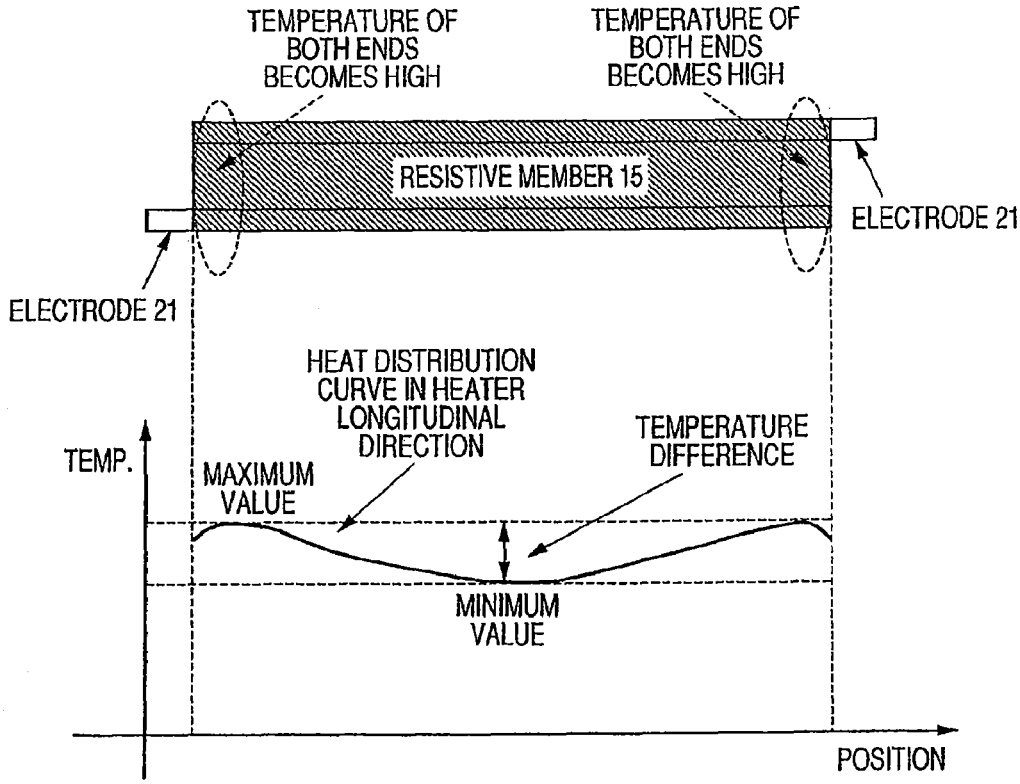
FIG. 9 is an explanatory diagram illustrating unevenness in heat generation in the heater according to the first embodiment of the present invention.

(4) Description of Supply Power Direction for the Heater (a) and (b) of FIG. 8 illustrate an example of a conventional heater 113, which are plan views of the heater 113 viewed from the side of the heat generation resistive member 115. FIG. 9 is an explanatory diagram illustrating unevenness in heat generation in the heater 13 illustrated in (a), (b) and (c) of FIG. 5.

The heater 113 illustrated in (a) of FIG. 8 has a structure in which the heat generation resistive member 115 reciprocates in the longitudinal direction of the substrate 114, i.e., the structure in which one heat generation resistive member 115 is connected in series via a conductive member 116 between two electrodes 121 and 122 contacting with the feed power connector on the printer main body side. The heater 113 illustrated in (b) of FIG. 8 has a structure in which the heat generation resistive member 115 goes only one way in the longitudinal direction of the substrate 114, i.e., the structure in which one heat generation resistive member 115 is connected in series via the conductive member 116 between the two electrodes 121 and 122 contacting with the feed power connector on the printer main body side. In the heater 113 of this type, when the small size recording material passes through, temperature of a small size pass-through area E (see FIG. 6A) is relatively decreased because heat is dissipated to the recording material, while temperature of a no sheet pass-through area F (see FIG. 6A) has a tendency to rise because heat is not dissipated. This tendency becomes more conspicuous in the heater having the form of the heater 113 as the heat generation resistive member 115 has the PTC characteristic of a larger value.

On the contrary, in the heater 13 of the pass-through direction conductive pattern type like this embodiment, current flow is formed not only in the longitudinal direction but also in the pass-through direction with respect to the substrate 14 even if the heat generation resistive member 15 having the similar PTC characteristic is used. In other words, if the temperature rises in the no sheet pass-through area F (see FIG. 6A) in which no recording material P passes, or the like of the heat generation resistive member 15, current hardly flows in the no sheet pass-through area F having a high resistance. Therefore, the current flows via the second areas 21*b* and 22*b* to the small size pass-through area E (see FIG. 6A) of the heat generation resistive member 15, in which the temperature hardly rises and becomes relatively low. For this reason, the characteristics that the energization state in the small size pass-through area E is secured while excessive temperature rise is suppressed in the no sheet pass-through area F are obtained. This effect of suppressing the excessive temperature rise becomes larger as a degree of the PTC characteristic is larger.

However, the heater 13 illustrated in FIG. 5 causes the phenomenon that the entire surface of the heat generation resistive member 15 is not uniform in the heat generation when the recording material P is not passed (led) in the nip portion N if the volume resistance value of the electrodes 21 and 22 is relatively similar to that of the heat generation resistive member 15. In this case, specifically, electric current at both ends in the longitudinal direction of substrate 14 becomes larger than that at the middle portion in the longitudinal direction thereof in the heat generation resistive member 15, and hence the heat generation distribution is also high at both ends while it is low at the middle portion (see FIG. 9). The reason for this is that a voltage drop occurs in the electrodes 21 and 22 because the electrodes 21 and 22 have resistances, which causes the phenomenon that current flowing into the heat generation resistive member 15 is decreased as the distance from a current inlet becomes large even within the electrodes 21 and 22.

With the shape of the heater 13 of this embodiment, i.e., the structure in which the inlet of current is disposed at each end portion in the longitudinal direction of the substrate 14, the position that is farthest from the current inlet is the middle position of the heat generation resistive member 15 while the position that is closest thereto is each end of the heat generation resistive member 15. Therefore, the heat generation distribution becomes high at both ends in the longitudinal direction of the heat generation resistive member 15 while becomes low at the middle of the same.

If the heat generation amount is higher at both end portions in the longitudinal direction of the substrate 14 than that at the middle portion in this way, the nonuniform heat generation distribution may cause unevenness of fixing, a defect of fixing, a hot offset, and a breakage of the heater.

(5) Relationship Between a Resistance Value R1 of the Electrode and a Resistance Value R2 of the Heat Generation Resistive Member In order to avoid this problem, the heat generation resistive member 15 should have a resistance value that is sufficiently larger than a resistance value of the electrodes 21 and 22. As a method for realizing this, it is considered to decrease the resistance value of the electrodes 21 and 22, to increase the resistance value of the heat generation resistive member 15, or a combination method thereof. Of course, it is preferable that the temperature unevenness in the longitudinal direction of the substrate 14 should be as small as possible, but it is allowable that the temperature is substantially 10° C. or lower.

Figure 10:
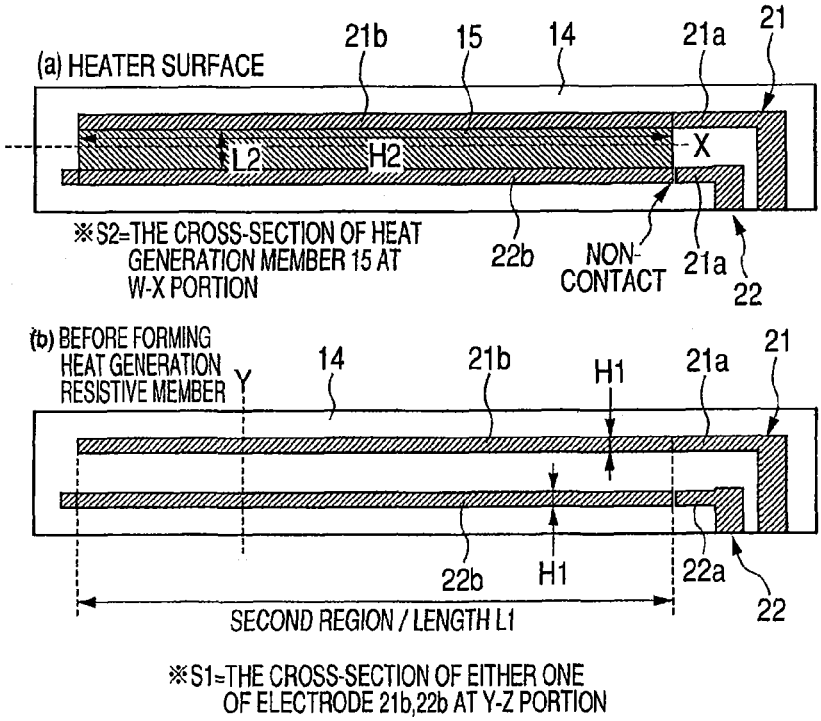
FIG. 10 is diagram illustrating major dimensions of the heater according to the first embodiment of the present invention.

Here, major dimensions of the heater 13 in this embodiment are defined as illustrated in (a) and (b) of FIG. 10. (a) of FIG. 10 is a plan view of the surface of the heater 13, and (b) of FIG. 10 is a plan view of the substrate 14 having only the electrodes 21 and 22 before the heat generation resistive member 15 is formed.

As to the electrodes 21 and 22, a cross-section of one of the second areas 21*b* and 22*b* in the short side direction of the substrate 14 (cross-section of the second area cut along the short side direction of the substrate) is denoted by S1, and a length of one of the second areas 21*b* and 22*b* in the longitudinal direction of the substrate 14 is denoted by L1. Here, as to the electrodes 21 and 22, the cross-sections of the second areas 21*b* and 22*b* have the same value, and the lengths of the second areas 21*b* and 22*b* also have the same value. In addition, concerning the heat generation resistive member 15, a cross-section thereof in the longitudinal direction of the substrate 14 (cross-section of the heat generation resistive member cut along the longitudinal direction of the substrate) is denoted by S2, and a length thereof in the supply power direction (i.e., distance between the second areas 21*b* and 22*b* of the two electrodes, or a length of the part where the second areas 21*b* and 22*b* do not overlap) is denoted by L2. Further, a volume resistance value of one of the second areas 21*b* and 22*b* when the non-fixed toner image t on the recording material P is heated is denoted by A1, and a volume resistance value of the heat generation resistive member 15 when the non-fixed toner image t on the recording material P is heated is denoted by A2. In other words, each of the volume resistance values A1 and A2 is a value at 200° C. that is a temperature during the image heat-fixing process of the fixing apparatus 8. Hereinafter, unless otherwise noted, the volume resistance values A1 and A2 are values at 200° C. that is a temperature during the image heat-fixing process. In this case, the resistance value R1 of one of the electrodes 21 and 22, and the resistance value R2 of the heat generation resistive member 15 are expressed as follows, respectively.

$$R1=A1\times L1/S1 \quad \text{(Relational expression 1)}$$

$$R2=A2\times L2/S2 \quad \text{(Relational expression 2)}$$

If the volume resistance value A1 of the heat generation resistive member 15 is set to be higher than the volume resistance value A2 of the electrodes 21 and 22, the heat generation distribution must be uniform. If the ratio (R2/R1) in this case is denoted by Nx, and if the heat generation distribution is regarded to be uniform, Relational Expression 3 holds as below.

$$R1\leqq R2/N \text{ (here, } N\geqq Nx) \quad \text{(Relational expression 3)}$$

In addition, the above-mentioned Relational Expression 3 is rewritten by substituting Relational Expressions 1 and 2. Then, it is understood that the heater with suppressed heat generation unevenness should be constituted so as to satisfy Relational Expression 4 below.

$$A1\leqq A2\times S1\times L2/N\times(S2\times L1) \text{ (here, } N\geqq Nx) \quad \text{(Relational expression 4)}$$

Specifically, as to the heater 13 having the structure illustrated in (a), (b) and (c) of FIG. 5, material and thickness of the heat generation resistive member 15 and the electrodes 21 and 22 are changed so as to make the following heaters.

Heater Example 1

As the electrode, a silver electrode having A1=2.10E−8 [Ω·m] ($(2.1\times10^{-8})$ [Ω·m]) was used. As for the heat generation resistive member, ruthenium tetroxide paste having A2=2.60E−2 [Ω·m] and the PTC characteristic of 7 ppm/° C. was used.

Heater Example 2

As the electrode, a silver electrode having A1=3.20E−8 [Ω·m] with silver purity lower than that of Heater example 1 was used. As for the heat generation resistive member, the same material as Heater example 1 was used but only the cross-section was reduced.

Heater Example 3

Totally the same materials as Heater example 1 were used as for the electrode and the heat generation resistive member. The cross-section of the electrode was set to be smaller than that of Heater example 1. The cross-section of the heat generation resistive member was also set to be smaller than that of Heater example 1.

Heater Example 4

Totally the same materials as Heater example 3 were used as for the electrode and the heat generation resistive member. Only the cross-section of the heat generation resistive member was set to be larger than that of Heater example 3.

Heater Example 5

Totally the same materials as Heater example 2 were used as for the electrode and the heat generation resistive member. Only the cross-section of the heat generation resistive member was set to be larger than that of Heater example 2.

Comparative Example 1

The same materials as Heater example 2 and Heater example 5 were used as for the electrode and the heat generation resistive member. Only the cross-section of the heat generation resistive member was set to be larger than that of Heater example 5.

Comparative Example 2

Totally the same materials as Heater example 1, Heater example 3 and Heater example 4 were used as for the electrode and the heat generation resistive member. The cross-section of the heat generation resistive member was set to be larger than that of Heater example 1.

Comparative Example 3

Totally the same materials as Heater example 1, Heater example 3, Heater example 4 and Comparative example 2 were used as for the electrode and the heat generation resistive member. Only the cross-section of the electrode was set to be smaller than that of the Comparative example 2.

Comparative Example 4

Totally the same materials as Heater example 2, Heater example 5 and the Comparative example 1 were used as for the electrode and the heat generation resistive member. The cross-section of the electrode was set to be smaller than that of the Comparative example 1, and the cross-section of the heat generation resistive member was also set to be smaller than that of the Comparative example 1. Table 1 indicates concrete dimensions and volume resistance values of the above-mentioned heaters.

TABLE 1

Dimensions of heaters of embodiments and Comparative examples using ruthenium tetroxide paste

| Heater | Electrodes | | | | | |
|---|---|---|---|---|---|---|
| Example | Material | A1 | S1 | T1 | H1 | L1 |
| Heater Example 1 | Silver | 2.10E−08 | 7.00E−09 | 1.00E−05 | 7.00E−04 | 2.20E−01 |
| Heater Example 2 | Silver | 3.20E−08 | 7.00E−09 | 1.00E−05 | 7.00E−04 | 2.20E−01 |
| Heater Example 3 | Silver | 2.10E−08 | 6.00E−09 | 1.00E−05 | 6.00E−04 | 2.20E−01 |
| Heater Example 4 | Silver | 2.10E−08 | 6.00E−09 | 1.00E−05 | 6.00E−04 | 2.20E−01 |
| Heater Example 5 | Silver | 3.20E−08 | 7.00E−09 | 1.00E−05 | 7.00E−04 | 2.20E−01 |
| Comparative Example 1 | Silver | 3.20E−08 | 7.00E−09 | 1.00E−05 | 7.00E−04 | 2.20E−01 |
| Comparative Example 2 | Silver | 2.10E−08 | 7.00E−09 | 1.00E−05 | 7.00E−04 | 2.20E−01 |
| Comparative Example 3 | Silver | 2.10E−08 | 5.00E−09 | 1.00E−05 | 5.00E−04 | 2.20E−01 |
| Comparative Example 4 | Silver | 3.20E−08 | 5.00E−09 | 1.00E−05 | 5.00E−04 | 2.20E−01 |

TABLE 1-continued

| Dimensions of heaters of embodiments and Comparative examples using ruthenium tetroxide paste | | | | | | |
|---|---|---|---|---|---|---|
| Heater | Heat generation resistive member | | | | | |
| Example | Material | A2 | S2 | T2 | H2 | L2 |
| Heater Example 1 | Ruthenium tetroxide paste | 2.60E−02 | 5.50E−06 | 2.50E−05 | 2.20E−01 | 5.00E−03 |
| Heater Example 2 | Ruthenium tetroxide paste | 2.60E−02 | 3.96E−06 | 1.80E−05 | 2.20E−01 | 5.00E−03 |
| Heater Example 3 | Ruthenium tetroxide paste | 2.60E−02 | 5.28E−06 | 2.40E−05 | 2.20E−01 | 5.00E−03 |
| Heater Example 4 | Ruthenium tetroxide paste | 2.60E−02 | 5.50E−06 | 2.50E−05 | 2.20E−01 | 5.00E−03 |
| Heater Example 5 | Ruthenium tetroxide paste | 2.60E−02 | 4.40E−06 | 2.00E−05 | 2.20E−01 | 5.00E−03 |
| Comparative Example 1 | Ruthenium tetroxide paste | 2.60E−02 | 5.50E−06 | 2.50E−05 | 2.20E−01 | 5.00E−03 |
| Comparative Example 2 | Ruthenium tetroxide paste | 2.60E−02 | 7.04E−06 | 3.20E−05 | 2.20E−01 | 5.00E−03 |
| Comparative Example 3 | Ruthenium tetroxide paste | 2.60E−02 | 7.04E−06 | 3.20E−05 | 2.20E−01 | 5.00E−03 |
| Comparative Example 4 | Ruthenium tetroxide paste | 2.60E−02 | 4.62E−06 | 2.10E−05 | 2.20E−01 | 5.00E−03 |

In Table 1, the volume resistance values A1 and A2 have a unit of [Ω·m] and values at 200° C. that is an operating temperature of the heater. In addition, a unit of the cross-sections S1 and S2 is square meter [$m^2$]. T1 denotes the film thickness of the electrodes 21 and 22. T2 denotes the film thickness of the heat generation resistive member 15. H1 denotes a width of the electrodes 21 and 22 (length in the short side direction of the substrate) ((b) of FIG. 10). H2 denotes a width of the heat generation resistive member 15 (length in the longitudinal direction of the substrate) ((a) of FIG. 10). A unit of each dimension is meter [m].

Note that each of the volume resistance values A1 and A2 of the heat generation resistive member 15 at 200° C. was measured by the following method. The heat generation resistive member 15 was formed on the glass substrate in a shape having a surface area of 5 mm×12 mm and a thickness of 10 microns as a discrete heater, and it was placed on a heated hot plate together with the substrate so as to be heated up to a temperature of 200° C. After that, a resistance value of a 5 mm×10 mm area was measured by a resistance measuring instrument (Fluke 87V manufactured by Fluke Corporation) with a probe having a width of 5 mm. Then, the measured value was converted into the volume resistance value, which is described in Table 1.

Here, in order to determine a value of Nx, a ratio of heaters R2/R1=N (hereinafter referred to as an "N value") was determined. Then, a relationship between the N value and the heat generation unevenness was investigated. Results thereof are indicated in Table 2 below.

TABLE 2

| Relationship between the N value and the heat generation unevenness of heaters of this embodiment and Comparative examples | | | | |
|---|---|---|---|---|
| | A1 | N | Rac | Heat generation unevenness |
| Heater Example 1 | 2.1E−08 | 35.8 | 25.8 | 3° C. |
| Heater Example 2 | 3.2E−08 | 32.6 | 36.2 | 5° C. |
| Heater Example 3 | 2.1E−08 | 32.0 | 27.2 | 5° C. |
| Heater Example 4 | 2.1E−08 | 30.7 | 26.2 | 7° C. |
| Heater Example 5 | 3.2E−08 | 29.4 | 32.9 | 10° C. |
| Comparative Example 1 | 3.2E−08 | 23.5 | 27.0 | 15° C. |
| Comparative Example 2 | 2.1E−08 | 28.0 | 20.7 | 11° C. |
| Comparative Example 3 | 2.1E−08 | 20.0 | 21.5 | 20° C. |
| Comparative Example 4 | 3.2E−08 | 20.0 | 32.8 | 20° C. |

In Table 2, Rac denotes a total resistance value, which is a resistance value measured between the point A of the electrode 21 and the point C of the electrode 22 illustrated in (a), (b) and (c) of FIG. 5. As indicated in Table 2, it is understood that if the N value is 29.4 or larger, the heat generation unevenness becomes 10° C. or lower that can be regarded to be uniform. In addition, as the N value is above 29.4, the heat generation unevenness is smaller. On the contrary, as the same is below 29.4, the heat generation unevenness is larger.

Therefore, according to the above-mentioned Relational Expression 4, the heat generation unevenness can be uniform if the following expression is satisfied.

$$A1 \leqq A2 \times S1 \times L2/(29.4 \times S2 \times L1) \quad \text{(Relational Expression 4b)}$$

The measurement of the heat generation unevenness was performed as follows. Temperature of the discrete heater was controlled at 200° C., while the heat generation distribution was measured with a thermography. As illustrated in FIG. 9, the maximum value of a difference between heat generation peak temperature (maximum value) at both end portions and heat generation temperature (minimum value) at the middle portion in the heat generation distribution curve along the longitudinal direction of the heater is recorded.

(a), (b) and (c) of FIG. 5 illustrate an example where the heater 13 is made up of only one pass-through direction conductive pattern.

Figure 11:
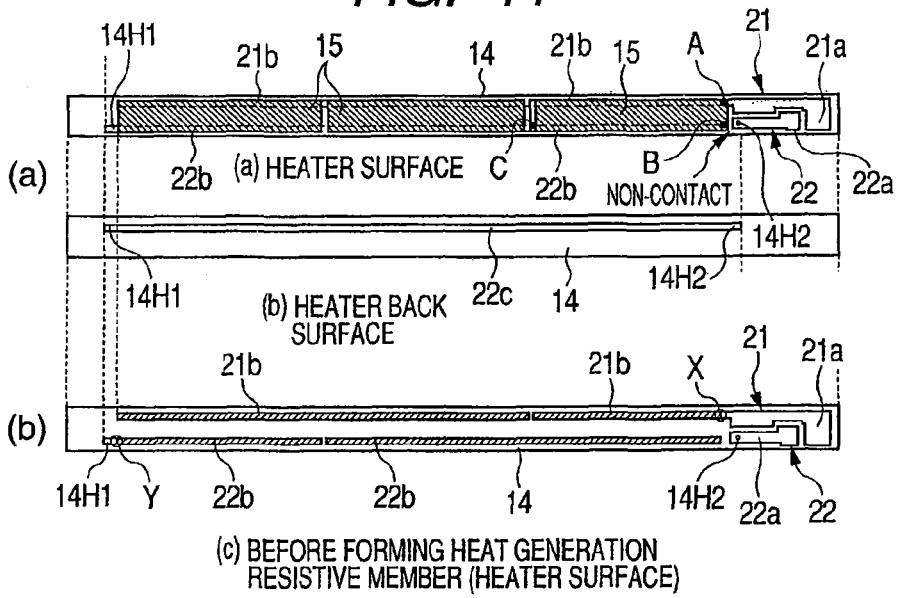
FIG. 11 is diagram illustrating another example of the heater according to the first embodiment of the present invention.

(a), (b) and (c) of FIG. 11 illustrate another example of the heater 13 according to this embodiment. In (a), (b) and (c) of FIG. 11, the same member or part as that of the heater 13 illustrated in (a), (b) and (c) of FIG. 5 is denoted by the same reference numeral. (a) of FIG. 11 is an explanatory diagram of a surface of the heater 13, (b) of FIG. 11 is an explanatory diagram of a back surface of the heater 13, and (c) of FIG. 11 is an explanatory diagram of an arrangement form of the first electrode 21 and the second electrode 22 before the heat generation resistive member 15 is formed on the substrate 14.

The heater 13 illustrated in (a), (b) and (c) of FIG. 11 has a structure in which a plurality of the pass-through direction conductive patterns are disposed in the longitudinal direction of the substrate 14. The electrodes 21 and 22 have a plurality of the second areas 21*b* and 22*b* having different lengths along the longitudinal direction of the substrate 14. The second areas 21*b* and 22*b* having different lengths are connected to the heat generation resistive member 15 disposed in parallel along the longitudinal direction of the substrate 14. The part of the heater 13 that is electrically closest to the first area 21*a* in the second area 21*b* of the electrode 21 (part X) is disposed in a vicinity of one end portion (inside of the end portion) in the longitudinal direction of the substrate 14. In addition, the part that is electrically closest to the first area 22*a* in the second area 22*b* of the electrode 22 (part Y) is disposed in a vicinity of the other end portion (inside of the end portion) in the longitudinal direction of the substrate 14. In other words, as to the heater 13 illustrated in (a), (b) and (c) of FIG. 11, the inlet of current from the electrodes 21 and 22 to the heat generation resistive member 15 is also divided into two at the both end portions in the longitudinal direction of the substrate 14. Therefore, the heater 13 illustrated in (a), (b) and (c) of FIG. 11 can also obtain the same action and effect as the heater 13 illustrated in (a), (b) and (c) of FIG. 5 and FIG. 7.

The resistance value Rac is measured in the state where the heater 13 is heated at 200° C. in this embodiment, but there are multiple levels of the set temperatures in the heat-fixing process as described above. Therefore, it is preferable to satisfy Relational Expression 4b for all the set temperatures set in the fixing apparatus 8.

Next, the conventional heater 113 illustrated in (a) of FIG. 8 is compared with Heater examples 1 to 5 of this embodiment about temperature rise at the no sheet pass-through portion (temperature rise at the no sheet pass-through area). In order to secure the same condition for comparing the temperature rise at the no sheet pass-through portion, the individual heaters of the conventional heater 113 and Heater examples 1 to 5 were assembled to one fixing apparatus one by one so that the fixing performances thereof were adjusted to be uniform, and the temperature rise at the no sheet pass-through portions thereof was compared at each controlled temperature.

As the conditions, ten cards were fed continuously under the environment of room temperature of 23° C. and humidity of 50% for measuring the temperature difference. The temperature at the surface of the pressure roller was measured by a thermocouple disposed between the pressure roller and felt made of heat resistant fibers contacting with the pressure roller. Temperature of the heater was controlled by using a thermistor disposed at the heater back surface in the sheet pass-through portion (pass-through area). In addition, an input voltage is adjusted for each heater.

Table 3 indicates results thereof.

TABLE 3

Comparison of surface temperatures of the pressure roller

| | Surface temperature of the pressure roller at the sheet pass-through portion (° C.) | Surface temperature of the pressure roller at the no sheet pass-through portion (° C.) | Temperature difference (° C.) |
|---|---|---|---|
| This embodiment Heater Example 1 | 135° C. | 205° C. | 70° C. |
| This embodiment Heater Example 2 | 135° C. | 207° C. | 72° C. |
| This embodiment Heater Example 3 | 135° C. | 208° C. | 73° C. |
| This embodiment Heater Example 4 | 135° C. | 212° C. | 77° C. |
| This embodiment Heater Example 5 | 135° C. | 215° C. | 80° C. |
| Conventional example | 135° C. | 235° C. | 100° C. |

From a result of the above-mentioned Table 3, it is understood that the temperature difference between the no sheet pass-through portion and the sheet pass-through portion is significantly decreased in both Heater examples 1 and 2 of this embodiment so that the margin is increased compared with the conventional example.

As described above, it is understood that the heat generation distribution of the heat generation resistive member 15 can be uniform if the heater 13 is constituted so that Relational Expression 4b "A1≦A2×S1×L2/(29.4×S2×L1)" is satisfied. In addition, a temperature difference between the pass-through area through which the small size recording material P passes and the no sheet pass-through area through which the same does not pass can be decreased. Therefore, the fixing apparatus 8 equipped with the heater 13 can have an increased margin between the temperature for securing fixing performance of the non-fixed toner image t on the small size recording material P and the temperature at which the temperature rise in the no sheet pass-through area may cause a damage to a component of the fixing apparatus 8. Thus, comparing with the longitudinal dimension of the current fixing apparatus 8, a relatively small size recording material P can be printed at increased speed.

Second Embodiment

Another embodiment of the heater is described. In this embodiment, the same member or part as that of the heater 13 of the first embodiment is denoted by the same reference numeral so that overlapping description is omitted. The same is true for a third embodiment of the present invention.

It is understood that the heater of the pass-through direction conductive pattern type can have uniform heat generation distribution by constituting it so that the N value increases as described in the first embodiment.

The N value can be described as follows using Relational Expressions 1 and 2.

$$N=(A2/A1)\times(L2/L1)\times(S1/S2) \quad \text{(Relational Expression 4c)}$$

The length L1 and the width H1 of the electrode, as well as the length L2 and the width H2 of the heat generation resistive member are substantially limited when the size of the fixing apparatus (heater) is determined. Therefore, it is understood that increase of the N value depends largely on volume resistance values of the material and thicknesses of the heat generation resistive member and the electrode.

The heater 13 of this embodiment is characterized in that the ratio of the cross-section S1 of the electrode to the cross-section S2 of the heat generation resistive member is set to be large, and hence the N value is set to be 29.4 or larger and that the volume resistance value A2 of the electrodes 21 and 22 can be small. Thus, uniform heat generation distribution is realized, and the effect of suppressing the temperature rise in the no sheet pass-through area can be increased.

First, for example, S1/S2 is estimated roughly in the case where both the heat generation resistive member 15 and the electrodes 21 and 22 are formed by the screen printing method as described in the first embodiment. In general, the minimum film thickness that can be formed by the screen printing method is the order of a several microns. Therefore, the film thickness T2 of the heat generation resistive member 15 is the same as the film thickness T1 of the electrodes 21 and 22. In addition, the width H2 of the heat generation resistive member 15 (length in the longitudinal direction of the substrate) has a value corresponding to the length of the substrate 14 (approximately 200 to 300 mm), while the width H1 of the electrodes 21 and 22 (length in the short side direction of the substrate) has only a value corresponding to the width of the nip portion N (approximately several millimeters). Therefore, S1/S2 can only have a value of one hundredth or less order.

Therefore, if the electrodes 21 and 22 are formed by the screen printing method, the volume resistance value of the heat generation resistive member 15 should be an order of approximately E−3 to E−2 [Ω·m] in order to satisfy Relational Expression 4b.

However, a substance having this order of volume resistance value bears characteristics of a semiconductor rather than characteristics of an electric conductor, electrically. Therefore, there are only a few cases where the resistance temperature characteristics indicate a conspicuous PTC characteristic, and many of them indicate a mild PTC characteristic or are close to zero. Searching under the condition that the material is substantially used for the screen printing method and the condition that the PTC characteristic is large, there are few materials that are suitable for the heater of the pass-through direction conductive pattern type.

As described above, it is preferable that the degree of the PTC characteristic should be large as a resistance of the heater of the pass-through direction conductive pattern type. For this reason, it is preferable that a substance having the order of the volume resistance value of 1.0E−5 [Ω·m] or lower should be used. In addition, it is necessary that the thickness of the heat generation resistive member is as thin as possible, and that the thickness of the electrode is as thick as possible.

As a method of forming a thin film, there is a sputtering method, for example. If the heat generation resistive member 15 is formed by means of the sputtering method or the like, it is possible to realize a wide range of the film thickness of approximately several tens angstroms to one micron. In addition, combining with the method of forming the electrodes 21 and 22 by the screen printing method, the value of S1/S2 can be a larger value. As a result, the N value in Relational Expression 4 can be large, and hence the heater having excellent heat generation distribution can be manufactured. In addition, a material of the electrodes 21 and 22 can be selected from a wider range of the volume resistance value. Thus, the heat generation resistive member material having a large PTC characteristic can be used, and hence the higher effect of suppressing the temperature rise at the no sheet pass-through portion can be obtained.

Hereinafter, examples are described, in which the heat generation resistive member 15 is formed actually by the sputtering method so that the heater having the same appearance as that of the first embodiment illustrated in FIGS. 5A to 5C is manufactured.

Heater Example 6

A silver electrode having A1=3.20E−8 [Ω·m] was used as the electrode. Nichrome alloy metal having A2=7.5E−5 [Ω·m] and the PTC characteristic of 250 ppm/° C. (nichrome alloy containing iron and manganese; hereinafter referred to as a nichrome alloy 1) was used for the heat generation resistive member.

Heater Example 7

A silver electrode having A1=2.10E−8 [Ω·m] with a higher purity than that of Heater example 6 was used as the electrode. Nichrome alloy metal having A2=1.50E−6 [Ω·m] that is the volume resistance value lower than that of the nichrome alloy 1 (nichrome alloy containing iron) and the PTC characteristic of 240 ppm/° C. (nichrome alloy containing iron; hereinafter referred to as a nichrome alloy 2) was used for the heat generation resistive member 15.

Heater Example 8

A silver electrode having A1=3.20E−8 [Ω·m] was used as the electrode. Nichrome alloy metal having the volume resistance value of A2=1.30E−5 [Ω·m] and the PTC characteristic of 240 ppm/° C. (nichrome alloy excluding iron and manganese; hereinafter referred to as a nichrome alloy 3) was used for the heat generation resistive member.

Heater Example 9

Materials of the electrode and the heat generation resistive member were entirely the same as those of Heater example 7, and only the cross-section of the electrode was set to be smaller.

Comparative Example 5

Materials of the electrode and the heat generation resistive member were entirely the same as those of Heater example 9 and Heater example 7, and the cross-section of the electrode was set to be further smaller than that of Heater example 9.

Comparative Example 6

Materials of the electrode and the heat generation resistive member were entirely the same as those of Heater example 8, and only the cross-section of the heat generation resistive member was set to be larger.

Comparative Example 7

Materials of the electrode and the heat generation resistive member were entirely the same as those of Heater example 6 and Heater example 8, and only the cross-section of the heat generation resistive member was set to be further larger than that of Heater example 8.

Table 4 indicates concrete dimensions and volume resistance values of the individual heaters described above.

TABLE 4

Structures of Heater examples of this embodiment and Comparative examples using resistive members having films formed by sputtering

| Heater | Electrodes | | | | | |
|---|---|---|---|---|---|---|
| Example | Material | A1 | S1 | T1 | H1 | L1 |
| Heater Example 6 | Silver | 3.20E−08 | 7.00E−09 | 1.00E−05 | 7.00E−04 | 2.20E−01 |
| Heater Example 7 | Silver | 2.10E−08 | 2.40E−08 | 2.00E−05 | 1.20E−03 | 2.20E−01 |
| Heater Example 8 | Silver | 3.20E−08 | 7.00E−09 | 1.00E−05 | 7.00E−04 | 2.20E−01 |
| Heater Example 9 | Silver | 2.10E−08 | 1.80E−08 | 2.00E−05 | 9.00E−04 | 2.20E−01 |
| Comparative Example 5 | Silver | 2.10E−08 | 1.80E−08 | 2.00E−05 | 9.00E−04 | 2.20E−01 |
| Comparative Example 6 | Silver | 3.20E−08 | 7.00E−09 | 1.00E−05 | 7.00E−04 | 2.20E−01 |
| Comparative Example 7 | Silver | 3.20E−08 | 7.00E−09 | 1.00E−05 | 7.00E−04 | 2.20E−01 |

| Heater | Heat generation resistive member | | | | | |
|---|---|---|---|---|---|---|
| Example | Material | A2 | S2 | T2 | H2 | L2 |
| Heater Example 6 | Nichrome alloy | 7.50E−05 | 7.70E−09 | 3.50E−08 | 2.20E−01 | 5.00E−03 |
| Heater Example 7 | Nichrome alloy | 1.50E−06 | 1.10E−09 | 5.00E−09 | 2.20E−01 | 6.00E−03 |
| Heater Example 8 | Nichrome alloy | 1.30E−05 | 2.20E−09 | 1.00E−08 | 2.20E−01 | 5.00E−03 |
| Heater Example 9 | Nichrome alloy | 1.50E−06 | 1.10E−09 | 5.00E−09 | 2.20E−01 | 6.00E−03 |
| Comparative Example 5 | Nichrome alloy | 1.50E−06 | 2.20E−09 | 1.00E−08 | 2.20E−01 | 5.00E−03 |
| Comparative Example 6 | Nichrome alloy | 1.30E−05 | 2.64E−09 | 1.20E−08 | 2.20E−01 | 5.00E−03 |
| Comparative Example 7 | Nichrome alloy | 1.30E−05 | 3.08E−09 | 1.40E−08 | 2.20E−01 | 5.00E−03 |

The volume resistance values A1 and A2 in Table 4 have a unit of [Ω·m] and values at 200° C. that is the operating temperature of the heater. In addition, the cross-sections S1 and S2 have a unit of square meter [$m^2$]. T1 denotes the film thickness of the electrodes 21 and 22. T2 denotes the film thickness of the heat generation resistive member 15. H1 denotes the width of the electrodes 21 and 22 (length in the short side direction of the substrate). H2 denotes the width of the heat generation resistive member 15 (length in the longitudinal direction of the substrate). The unit of each dimension is meter [m].

Note that the volume resistance values A1 and A2 of the heat generation resistive member 15 at 200° C. were measured by the following method. The heat generation resistive member 15 was formed on the glass substrate in the shape having a surface area of 5 mm×12 mm and the same thickness as each heater under the same condition as the film formed as the heater, and was placed on a heated hot plate together with the substrate so as to be heated up to a temperature of 200° C. After that, a resistance value of a 5 mm×10 mm area was measured by the resistance measuring instrument (Fluke 87V manufactured by Fluke Corporation) with the probe having the width of 5 mm. Then, the measured value was converted into the volume resistance value, which is described in Table 4.

Table 5 indicates results of actually measuring the N value and temperature distribution using the heaters described above.

TABLE 5

Relationship between N value and heat generation unevenness of heaters of Heater examples and Comparative examples in the second embodiment

| | A1 | N | Rab | Heat generation unevenness |
|---|---|---|---|---|
| Heater Example 6 | 3.20E−08 | 48.4 | 52.0 | 2° C. |
| Heater Example 7 | 2.10E−08 | 42.5 | 8.8 | 3° C. |

TABLE 5-continued

Relationship between N value and heat generation unevenness of heaters of Heater examples and Comparative examples in the second embodiment

| | A1 | N | Rab | Heat generation unevenness |
|---|---|---|---|---|
| Heater Example 8 | 3.20E−08 | 29.4 | 32.9 | 10° C. |
| Heater Example 9 | 2.10E−08 | 31.9 | 9.0 | 10° C. |
| Comparative Example 5 | 2.10E−08 | 13.3 | 4.3 | 18° C. |
| Comparative Example 6 | 3.20E−08 | 24.5 | 28.0 | 15° C. |
| Comparative Example 7 | 3.20E−08 | 21.0 | 24.4 | 16° C. |

In Table 5, Rab denotes a total resistance value, which was measured between the point A of the electrode 21 and the point B of the electrode 22 as illustrated in (a), (b) and (c) of FIG. 5.

From above description, it is understood that the N value should be 29.4 or larger in order that the unevenness of the heat generation distribution becomes 10° C. or lower also in the heater made by the sputtering method.

In addition, it is understood that the use of the sputtering method enables the volume resistance value A2 of the heat generation resistive member 15 to be the first half of E−6 like Heater example 7 or Heater example 9 without limiting to 1.0E−5.

With the structure as described above, a substantially uniform energized state can be obtained over the entire area of the heat generation resistive member 15. Thus, a temperature difference between the end portion and the middle portion in the longitudinal direction thereof can be reduced, whereby a uniform heat generation distribution can be obtained.

Next, it is described that Heater examples 6 to 9 of this embodiment have the higher effect of suppressing the temperature rise at the no sheet pass-through portion compared with the conventional heater 113 having the structure in which the heat generation member reciprocates as described in the first embodiment. In order to realize the same condition for the temperature rise at the no sheet pass-through portion, the individual heaters of the conventional heater 113 and Heater examples 6 to 9 were assembled to the fixing apparatus one by one, and the temperature rise at the no sheet pass-through portion was compared.

As the conditions, ten cards were passed continuously under the environment of room temperature of 23° C. and humidity of 50%. Then, the pressure roller temperatures at the sheet pass-through portion and the no sheet pass-through portion, and its temperature difference were compared. The temperature on the surface of the pressure roller was measured by a thermocouple disposed between the pressure roller and felt made of heat resistant fibers contacting with the pressure roller. Temperature of the heater was controlled by using a thermistor disposed on the heater back surface in the sheet pass-through portion (pass-through area). In addition, an input voltage is adjusted for each heater.

Table 6 shows results thereof.

TABLE 6

Comparative of surface temperatures of the pressure roller when the temperature at the sheet pass-through portion rises in each heater of the second embodiment and the conventional example

| | Surface temperature of pressure roller at sheet pass-through portion (° C.) | Surface temperature of pressure roller at no sheet pass-through portion (° C.) | Temperature difference (° C.) |
|---|---|---|---|
| This embodiment Heater Example 6 | 135° C. | 195° C. | 60° C. |
| This embodiment Heater Example 7 | 135° C. | 185° C. | 50° C. |
| This embodiment Heater Example 8 | 135° C. | 208° C. | 73° C. |
| This embodiment Heater Example 9 | 135° C. | 197° C. | 62° C. |
| Conventional example | 135° C. | 235° C. | 100° C. |

From results of Table 6 above, it is understood that the temperature difference between the no sheet pass-through portion and the sheet pass-through portion is substantially decreased in any of Heater examples 6, Heater example 7, Heater example 8, and Heater example 9 of this example so that the margin is increased compared with the conventional example.

In addition, particularly, comparing with the Ruthenium oxide heater 13 of the above-mentioned the first embodiment, the heater 13 of the second embodiment can use a material having a larger resistance temperature characteristic by using a material having a small volume resistance value of the order of 1.0E−5 [Ω·m] or smaller. From this, it is understood that it is possible to obtain a larger effect than the first embodiment regarding the N value in suppressing a temperature difference between the pass-through area through which the small size recording material P passes and the no sheet pass-through area through which the small size recording material P does not pass, i.e., the temperature rise at the no sheet pass-through portion.

With the structure of the heater 13 of this embodiment, the heat generation distribution of the heat generation resistive member 15 can be made uniform. In addition, the temperature difference between the pass-through area through which the small size recording material P passes and the no sheet pass-through area through which the small size recording material P does not pass can be reduced. Therefore, the fixing apparatus 8 equipped with the heater 13 of this embodiment can also increase a margin between the temperature for securing fixing performance of the non-fixed toner image t on the small size recording material P and the temperature at which the temperature rise in the no sheet pass-through area may cause a damage to a component of the fixing apparatus 8. Thus, comparing with the longitudinal dimension of the current fixing apparatus 8, a relatively small size recording material P can be printed at increased speed.

In addition, the resistance value Rab was measured in the state where the heater 13 is heated at 200° C. in this embodiment, but there are multiple levels of the set temperatures in the heat-fixing treatment similarly to the first embodiment. Therefore, it is favorable to satisfy the above-mentioned Relational Expression 4b for all the set temperatures set in the fixing apparatus 8.

In addition, the sputtering method was used as the method of forming a thin film of the heat generation resistive member 15 in this embodiment, but it is also possible to use a vapor deposition method or the like. In general, however, the sputtering method is favorable because it can obtain higher kinetic energy of an atom (molecule) of a target material so that a stronger thin film can be formed. In addition, the screen printing method is used as the method of forming the electrode in the above-mentioned Heater examples, but it is possible to adopt other film forming method for the electrode other than the screen printing method as long as the method can form the electrode having a sufficiently larger thickness than that of the heat generation resistive member formed by the sputtering method or the vapor deposition method.

In addition, the nichrome alloy was used as the material of the heat generation resistive member 15 in this embodiment, but it is also possible to use other metal, alloy, metal oxide, or semiconductor. However, it goes without saying that the higher the PTC characteristic of the material is, the larger the effect of suppressing the temperature rise at the no sheet pass-through portion becomes.

Third Embodiment

Another example of the heater is described.

In the first and second embodiments, the heat generation resistive member 15 is disposed on the surface of the substrate 14 of the heater 13, and the electrode 22 is patterned as follows for simplifying electrode contacts with the heat generation resistive member 15. Through holes 14*h*1 and 14*h*2 are formed in the substrate 14 for disposing the first areas 21*a* and 22*a* inside one end portion of the substrate 14, and an extension area 22*c* of the electrode 22 is connected to the second area 22*b* at the inside of the other end portion of the substrate 14 by using the through holes 14*h*1 and 14*h*2. With this structure, the feed power directions from the electrodes 21 and 22 become symmetric with respect to the heat generation resistive member 15 in the longitudinal direction of the substrate 14. Therefore, the temperature difference can be suppressed between the electrode side and the non-electrode side in the heat generation resistive member 15.

The heater 13 described in this embodiment is a heater having no current flowing between opposite corners of the electrode 21 and the electrode 22 with respect to the heat generation resistive member 15 in the longitudinal direction of the substrate 14. In other words, as in the case of the heater 13 of the first embodiment, the through holes 14*h*1 and 14*h*2 are not formed in the substrate 14, and the width of the substrate 14 is not increased, whereby the heat generation distribution of the heat generation resistive member 15 is uniformed in the longitudinal direction. This structure can reduce cost because the through holes 14*h*1 and 14*h*2 are not provided. In addition, the electrode contacts are disposed at the inside of one end portion of the substrate 14, and thus it is not necessary to increase the width of the substrate 14, leading to merits such as cost reduction and space saving.

Figure 12:
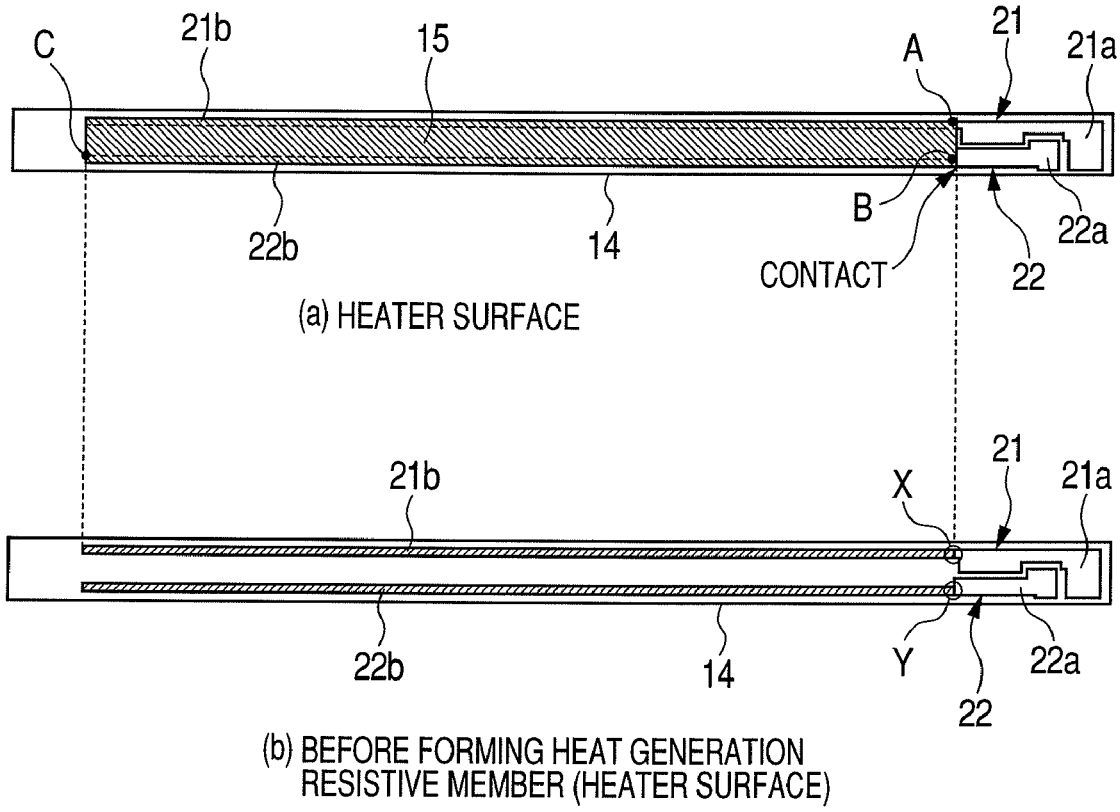
FIG. 12 is diagram illustrating an example of a heater according to a third embodiment of the present invention.
Figure 13:
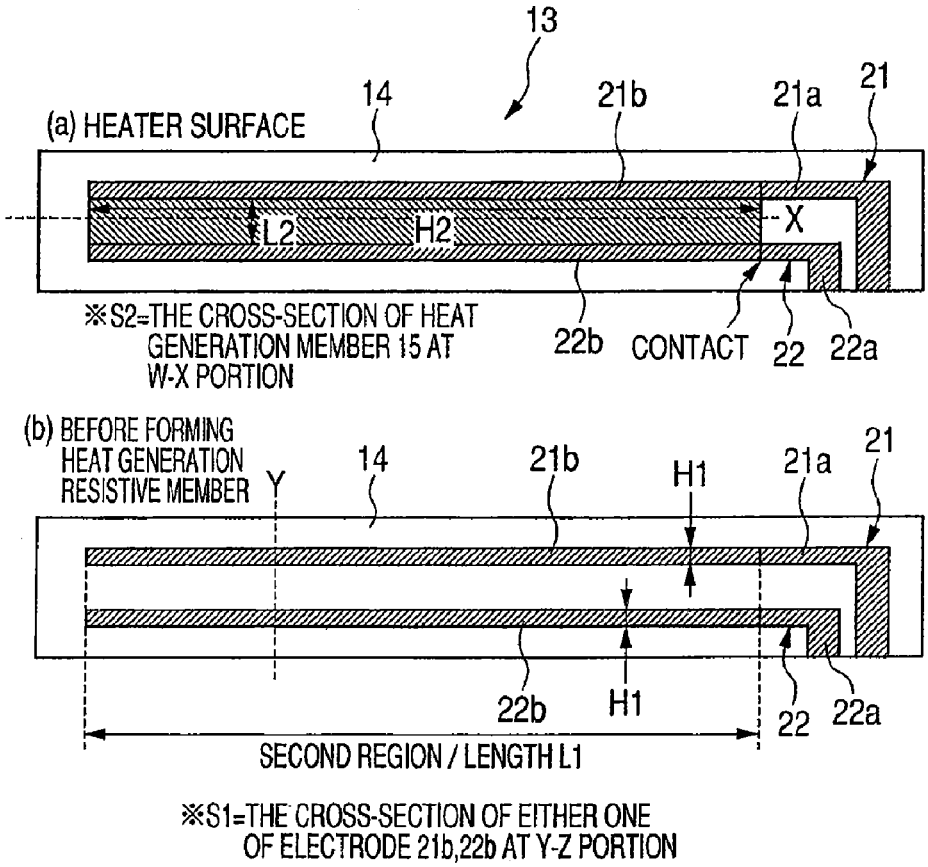
FIG. 13 is diagram illustrating major dimensions of the heater according to the third embodiment of the present invention.

FIG. 12 is a diagram illustrating an example of the heater 13 according to this embodiment. (a) of FIG. 13 is an explanatory diagram of a surface of the heater 13, and (b) of FIG. 13 is an explanatory diagram of an arrangement form of the first electrode 21 and the second electrode 22 before the heat generation resistive member 15 is formed on the substrate 14.

The heater 13 of this embodiment has the same structure as the heater 13 of the first embodiment except that the electrode 22 provided to the other end side in the short side direction of the substrate 14 has a form different from that of the electrode 22 of the heater 13 of the first embodiment.

The electrode 22 is formed in the same manner as the electrode 21. More specifically, the electrode 22 includes a first area 22*a* for feeding power and a second area 22*b* (gray thick line portion in (b) of FIG. 13) for feeding power to the heat generation resistive member 15, which are disposed on the surface of the substrate 14 (surface on the side of the nip portion N). The first area 22*a* is disposed at the inside of one end portion (right end portion) in the longitudinal direction of the substrate 14. The second area 22*b* is connected to the first area 22*a* and extends from the connection position therebetween to the inside of the other end portion (left end portion) along the longitudinal direction of the substrate 14. Further, the entire area in the longitudinal direction of the second area 22*b* is connected to the heat generation resistive member 15. Power is fed to the second area 22*b* via the first area 22*a*. Therefore, in the case of viewing the second area 22*b* from the first area 22*a* to be the feed power side, the second area 22*b* is disposed at the inside of the end portion opposite to the first area 22*a* on the substrate 14. The second area 22*b* connected to the heat generation resistive member 15 is indicated by the gray thick line for easy understanding in (b) of FIG. 13, but the material of the second area 22*b* is the same as the material of the first area 22*a* also in this embodiment.

In this embodiment, the first areas 21*a* and 22*a* and the second areas 21*b* and 22*b* of the electrodes 21 and 22 are made of the same material. In addition, the second areas 21*b* and 22*b* have a length of approximately 220 mm, a width of approximately 1 mm, and a thickness of approximately a few tens of microns.

Major dimensions of the heater 13 of this embodiment are defined as illustrated in FIGS. 13A and 13B. (a) of FIG. 13 is a plan view of the surface of the heater 13, and (b) of FIG. 13 is a plan view of the substrate 14 including only the electrodes 21 and 22 before the heat generation resistive member 15 is formed.

The cross-section S1, the length L1 and the volume resistance value A1 in the second areas 21*b* and 22*b* of the electrodes 21 and 22 are basically defined in the same manner as the heater 13 of the first embodiment. The cross-section S2, the length L2 in the feed power direction, and the volume resistance value A2 of the heat generation resistive member 15 are also basically defined in the same manner as the heater 13 of the first embodiment.

Figure 14:
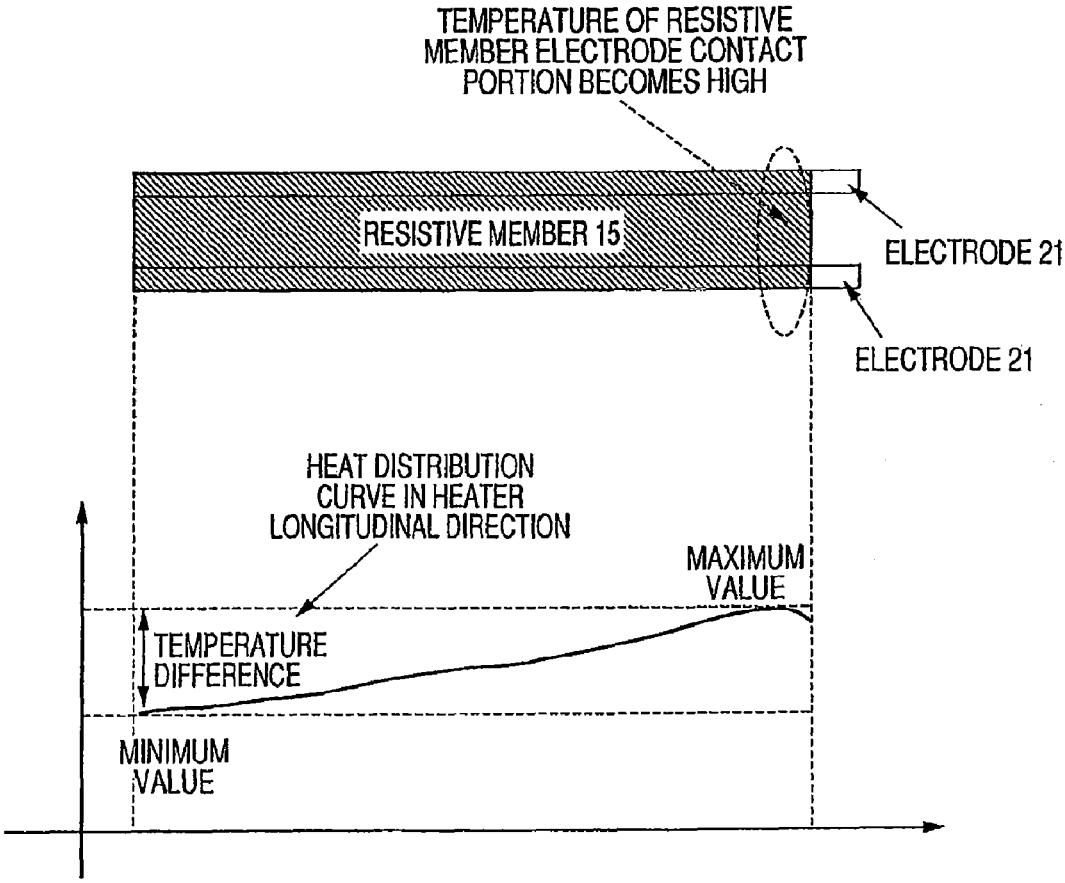
FIG. 14 is an explanatory diagram illustrating unevenness in heat generation in the heater according to the third embodiment of the present invention.
Figure 15:
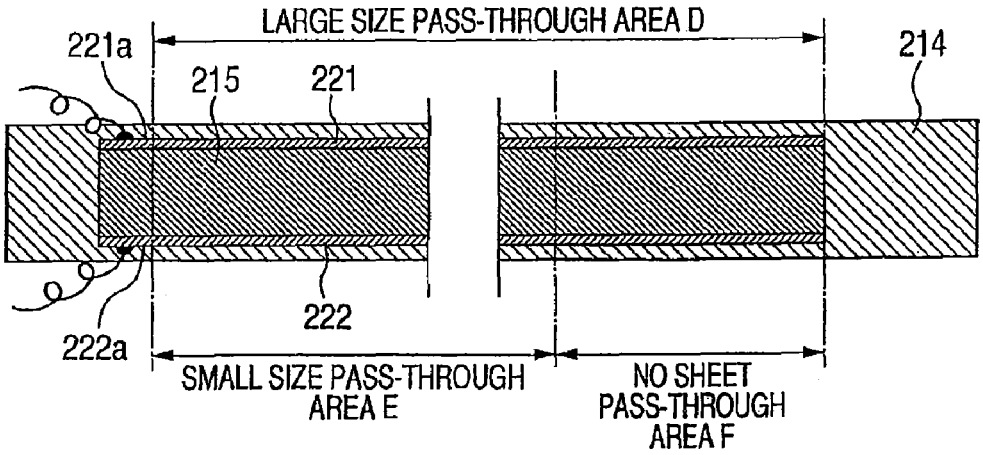
FIG. 15 PRIOR ART
FIG. 15 is a diagram illustrating an example of a conventional heater.
Figure 16:
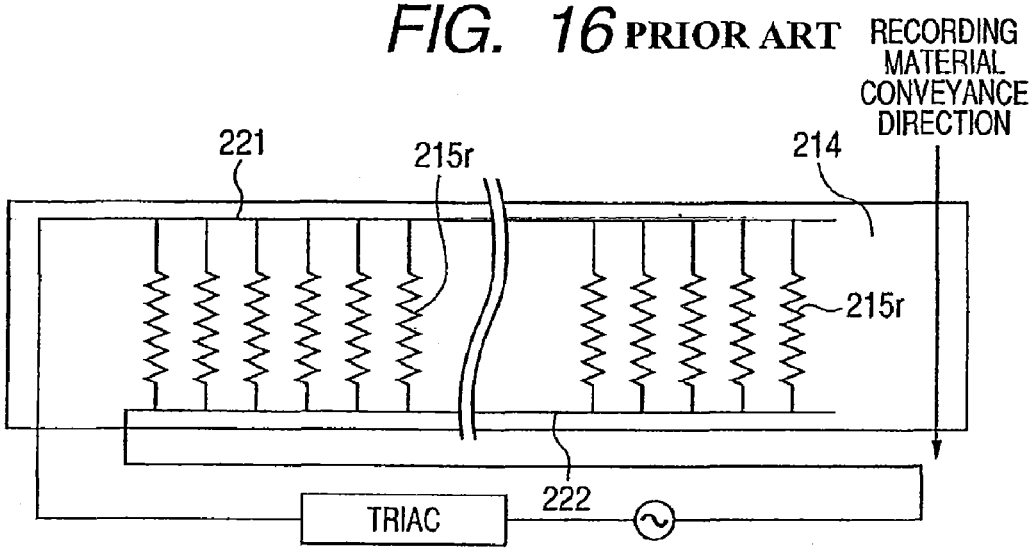
FIG. 16 PRIOR ART
FIG. 16 is a circuit diagram electrically illustrating the conventional heater of FIG. 15.

In addition, the heater 13 of this embodiment also does not become a uniform energized state if the volume resistance value of the electrodes 21 and 22 is similar to that of the heat generation resistive member 15 in the state where the recording material P is not passed (led) in the nip portion N. In other words, as illustrated in FIG. 14, the heat generation temperature distribution of the heat generation resistive member 15 in the longitudinal direction of the substrate 14 tends to be higher in the end portion of the feed power side than the end portion of the non-feed power side opposite to the end portion of the feed power side. This phenomenon occurs in a case resistance of the electrodes 21 and 22 at the set temperature cannot be ignored compared with resistance of the heat generation resistive member 15. Further, as to the heater 13 of this embodiment, the volume resistance value should be made larger than the heater 13 of the first embodiment and the second embodiment for substantially uniform heat generation.

Therefore, Heater examples having different volume resistance values are described below, which were actually realized by changing thicknesses of the electrodes 21 and 22 and the heat generation resistive member 15, and the composition of the heat generation resistive member 15.

Heater Example 10

As the electrode, a silver electrode having A1=3.20E−8 [Ω·m] was used. As a material of the heat generation resistive member, a nichrome alloy 1 having A2=7.5E−5 [Ω·m] was used.

Heater Example 11

A silver electrode having A1=2.10E−8 [Ω·m] with higher purity than Heater example 6 was used for the electrode. As to the heat generation resistive member, a nichrome alloy 2 having A2=1.50E−6 [Ω·m] that has lower volume resistivity than the nichrome alloy 1 was used.

Also as to the above-mentioned Heater example 10 and Heater example 11, it is favorable to form the heat generation resistive member on the substrate by the sputtering method or the vapor deposition method similarly to the second embodiment. In addition, the film forming method of the electrode can be any method as long as it can form the electrode having a thickness sufficiently larger than the thickness of the heat generation resistive member formed by the sputtering method or the vapor deposition method. In particular, it is favorable to form the film of the electrode by the screen printing method.

Comparative Example 8

The same electrode as that of Heater example 10 was used, and a nichrome alloy 4 having a volume resistance value of A2=1.50E−5 [Ω·m] was used for the heat generation resistive member.

Comparative Example 9

The materials of the electrode and the heat generation resistive member were totally the same as those of Heater example 11, and only the cross-section of the electrode was reduced.

Table 7 shows specific dimensions and volume resistance values of the above-mentioned individual heaters.

TABLE 7

Structures of Heater examples and Comparative examples in the third embodiment

| Heater | Electrodes | | | | | |
|---|---|---|---|---|---|---|
| Example | Material | A1 | S1 | T1 | H1 | L1 |
| Heater Example 10 | Silver | 3.20E−08 | 7.00E−09 | 1.00E−05 | 7.00E−04 | 2.20E−01 |
| Heater Example 11 | Silver | 2.10E−08 | 2.40E−08 | 2.00E−05 | 1.20E−03 | 2.20E−01 |
| Comparative Example 8 | Silver | 3.20E−08 | 7.00E−09 | 1.00E−05 | 7.00E−04 | 2.20E−01 |
| Comparative Example 9 | Silver | 2.10E−08 | 1.80E−08 | 2.00E−05 | 9.00E−04 | 2.20E−01 |

| Heater | Heat generation resistive member | | | | | |
|---|---|---|---|---|---|---|
| Example | Material | A2 | S2 | T2 | H2 | L2 |
| Heater Example 10 | Nichrome alloy | 7.50E−05 | 7.70E−09 | 3.50E−08 | 2.20E−01 | 8.00E−03 |
| Heater Example 11 | Nichrome alloy | 1.50E−06 | 1.10E−09 | 5.00E−09 | 2.20E−01 | 8.00E−03 |
| Comparative Example 8 | Nichrome alloy | 1.50E−05 | 2.20E−09 | 1.00E−08 | 2.20E−01 | 8.00E−03 |
| Comparative Example 9 | Nichrome alloy | 1.50E−06 | 1.10E−09 | 5.00E−09 | 2.20E−01 | 8.00E−03 |

In Table 7, the volume resistance values A1 and A2 have a unit of [Ω·m] and a value at 200° C. that is the operating temperature of the heater. In addition, the cross-sections S1 and S2 have a unit of square meter [$m^2$]. T1 represents a film thickness of the electrodes 21 and 22. T2 represents a film thickness of the heat generation resistive member 15. H1 represents a width of the electrodes 21 and 22. H2 represents a width of the heat generation resistive member 15. The unit of each dimension is meter [m].

In Table 7, the volume resistance values A1 and A2 of the heat generation resistive member 15 at 200° C. were measured by the following method. The heat generation resistive member 15 was formed on the glass substrate in a shape having a surface area of 5 mm×12 mm and the same thickness as each heater under the same conditions of the above-mentioned film forming of a discrete heater, and placed on a heated hot plate together with the substrate so as to be heated up to 200° C. After that, a resistance value of a 5 mm×10 mm area was measured by a resistance measuring instrument (Fluke 87V manufactured by Fluke Corporation) with a probe having a width of 5 mm. Then, the measured value was converted into the volume resistance value, which is described in Table 7.

Here, in order to determine a value of Nx, a ratio of heaters R2/R1=N (hereinafter referred to as an "N value") was determined. Then, a relationship between the N value and the heat generation unevenness was examined.

Table 8 shows a result.

TABLE 8

Relationship between the N value and the heat generation unevenness

| | A1 | N | Rab | Heat generation unevenness |
|---|---|---|---|---|
| Heater Example 10 | 3.20E−08 | 77.5 | 81.2 | 3° C. |
| Heater Example 11 | 2.10E−08 | 56.7 | 11.5 | 10° C. |
| Comparative Example 8 | 3.20E−08 | 54.2 | 57.8 | 12° C. |
| Comparative Example 9 | 2.10E−08 | 42.5 | 11.7 | 17° C. |

In Table 8, Rab denotes a total resistance value, which is a resistance value measured between the point A of the electrode 21 and the point C of the electrode 22 illustrated in FIG. 12.

As understood from the results of Heater example 10 and Heater example 11 above, the heat generation difference was 10° C. or smaller when the N value was 56.7 or larger at 200° C. that is the set temperature. In addition, it is understood that the temperature difference decreases as the N value increases. In addition, as understood from Comparative example 8 and Comparative example 9 on the contrary, the heat generation difference exceeds 10° C. if the N value is 56.7 or smaller at the set temperature 200° C. It is understood that the heat generation difference increases as the N value decreases. Therefore, if the following Relational Expression 4d is satisfied in Relational Expression 4 described in the first embodiment, the heat generation unevenness can be made uniform.

$$A1 \leqq A2 \times S1 \times L2/(56.7 \times S2 \times L1) \quad \text{(Relational Expression 4d)}$$

The heat generation unevenness was measured as follows. The temperature of the discrete heater was controlled to be 200° C., and the heat generation distribution was measured by the thermography. As illustrated in FIG. 14, the differential maximum value was recorded, which is a difference between the heat generation peak temperature (maximum value) at the end portion on the feed power side and the heat generation temperature (minimum value) at the end portion on the non-feed power side of a heat generation distribution curve in the longitudinal direction of the heater.

Next, it is described that Heater example 10 and Heater example 11 actually have the effect of suppressing the temperature rise at the no sheet pass-through portion compared with the conventional heater 113 having the structure in which the heat generation member reciprocates as described in the first embodiment. In order to realize the same condition for the temperature rise at the no sheet pass-through portion, the individual heaters of the conventional heater 113 and Heater examples 10 and 11 were assembled to the fixing apparatus one by one, and the temperature rise at the no sheet pass-through portion was compared.

As the conditions for measuring the temperature difference, ten cards were fed continuously under the environment of room temperature of 23° C. and humidity of 50%. The temperature on the surface of the pressure roller was measured by a thermocouple disposed between the pressure roller and felt made of heat resistant fibers abutting on the pressure roller. Temperature of the heater was controlled by using a thermistor disposed at the heater back surface in the sheet pass-through portion (pass-through area). In addition, an input voltage is adjusted for each heater.

Table 9 shows a result thereof.

TABLE 9

Comparison of surface temperatures of the pressure roller when the temperature at the no sheet pass-through portion increases

| | Surface temperature of the pressure roller at the sheet pass-through portion (° C.) | Surface temperature of the pressure roller at the no sheet pass-through portion (° C.) | Temperature difference (° C.) |
|---|---|---|---|
| This embodiment Heater Example 10 | 135° C. | 195° C. | 60° C. |
| This embodiment Heater Example 11 | 135° C. | 185° C. | 50° C. |
| Conventional example | 135° C. | 235° C. | 100° C. |

From results of Table 9, it is understood that the temperature difference between the no sheet pass-through portion and the sheet pass-through portion is decreased to a large degree in both Heater example 10 and Heater example 11 of this embodiment so that the margin is increased, compared with the conventional example.

As described above, the heat generation distribution of the heat generation resistive member 15 can be uniform if the heater 13 is constituted so that Relational Expression 4d "A1≦A2×S1×L2/(56.7×S2×L1" is satisfied. In addition, a temperature difference between the pass-through area through which the small size recording material P passes and the no sheet pass-through area through which the small size recording material P does not pass can be decreased. Therefore, the fixing apparatus 8 equipped with the heater 13 can increase a margin between the temperature for securing fixing performance of the non-fixed toner image t on the small size recording material P and the temperature at which the temperature rise in the no sheet pass-through area may cause a damage to a component of the fixing apparatus 8. Thus, comparing with the longitudinal dimension of the current fixing apparatus 8, a relatively small size recording material P can be printed at an increased speed.

[Others]

The heater 13 that is mounted on the fixing apparatus 8 of the tensionless type film heating method is described in the first to third embodiments, but the same action and effect can be obtained if the heater 13 is mounted on a fixing apparatus of a tension type film heating method.

In addition, the surface of the substrate 14 on the side of the heat generation resistive member 15 in the heater 13 contacts with the inner surface of the film 12 in the first to third embodiments, but the same action and effect can be obtained if the back surface on the opposite side of the heat generation resistive member 15 of the substrate 14 is made to contact with the inner surface of the film 12. In this case, the thermistor 19 is disposed on the surface on the side of the heat generation resistive member 15 of the substrate 14.

This application claims priority based on Japanese Patent Application No. 2007-322076 filed on Dec. 13, 2007, the entire contents of which are hereby incorporated by reference.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-322076 filed Dec. 13, 2007, which is hereby incorporated by reference herein its entirety.

What is claimed is:

1. An image heating apparatus comprising:

a heater including a substrate, a heat generation resistive member formed on the substrate, and a first electrode and a second electrode for feeding power to the heat generating resistive member;

a backup member that forms a nip portion together with the heater; and a control unit that controls power to be fed to the heat generation resistive member so that temperature of the heater maintains a set temperature during an image heating process wherein the image heating apparatus heats an image on a recording material at the nip portion;

wherein each of the first electrode and the second electrode includes a first area contacting with a feed power connector and a second area on an electrically opposite side of the first area;

the second area is disposed along a longitudinal direction of the substrate;

the heat generation resistive member is disposed so as to electrically connect the second area of the first electrode with the second area of the second electrode;

the heat generation resistive member is formed by sputtering or vapor-depositing, a part of the second area of the first electrode electrically closest to the first area is disposed on one end portion side in the longitudinal direction of the substrate;

a part of the second area of the second electrode which is electrically closest to the first area is disposed on another end portion side in the longitudinal direction of the substrate;

a length of the second area of each of the first electrode and the second electrode in the longitudinal direction of the substrate is denoted by L1 [m] and a cross-section of the second area cut along a short side direction of the substrate is denoted by S1 [$m^2$];

a length of the heat generation resistive member in the short side direction is denoted by L2 [m] and a cross-section of the heat generation resistive member cut along the longitudinal direction is denoted by S2 [$m^2$]; and a volume resistance value of the second area of each of the first electrode and the second electrode at the set temperature is denoted by A1 [Ω·m] and a volume resistance value of the heat generation resistive member at the set temperature is denoted by A2 [Ω·m], $A1 \leqq A2 \times S1 \times L2/(29.4 \times S2 \times L1)$ is satisfied.

2. An image heating apparatus comprising:

a heater including a substrate, a heat generation resistive member formed on the substrate, and a first electrode and a second electrode for feeding power to the heat generation resistive member;

a backup member that forms a nip portion together with the heater;

a control unit that controls power to be fed to the heat generation resistive member so that temperature of the heater maintains a set temperature during an image heating process, wherein the image heats apparatus heats an image on a recording material at the nip portion;

wherein each of the first electrode and the second electrode includes a first area contacting with a feed power connector and a second area on an electrically opposite side of the first area;

the second area is disposed along a longitudinal direction of the substrate;

the heat generation resistive member is disposed so as to electrically connect the second area of the first electrode with the second area of the second electrode;

the heat generation resistive member is formed by sputtering or vapor-depositing, and a volume resistance value of the heat generation resistive member is equal to or smaller than 1.0E−5 [Ω·m].

3. An image heating apparatus according to claim 2, wherein the at least the second area of the first electrode and the second area of the second electrode are formed by a screen-printing.

4. An image heating apparatus according to any one of claims 1 to 2, further comprising a flexible sleeve rotating in a state in which an inner surface thereof contacts with the heater, wherein the flexible sleeve is sandwiched between the heater and the backup member, and hence a recording material bearing the image is processed by heat when the recording material is passing between the flexible sleeve and the backup member.

5. An image heating apparatus comprising:

a heater including a substrate, a heat generation resistive member formed on the substrate, and a first electrode and a second electrode for feeding power to the heat generation resistive member;

a backup member that forms a nip portion together with the heater; and a control unit that controls power to be fed to the heat generation resistive member so that temperature of the heater maintains a set temperature during an image heating process wherein the image heating apparatus heats an image on a recording material at the nip portion, wherein each of the first electrode and the second electrode includes a first area contacting with a feed power connector and a second area on an electrically opposite side of the first area;

the second area is disposed along a longitudinal direction of the substrate;

the heat generation resistive member is disposed so as to electrically connect the second area of the first electrode with the second area of the second electrode;

the heat generation resistive member is formed by sputtering or vapor-depositing, a part of the second area of the first electrode which is electrically closest to the first area and a part of the second area of the second electrode which is electrically closest to the first area are both disposed on one end portion side in the longitudinal direction of the substrate;

a length of the second area of each of the first electrode and the second electrode in the longitudinal direction of the substrate is denoted by L1 [m] and a cross-section of the second area cut along a short side direction of the substrate is denoted by S1 [$m^2$];

a length of the heat generation resistive member in the short side direction is denoted by L2 [m] and a cross-section of the heat generation resistive member cut along the longitudinal direction is denoted by S2 [$m^2$]; and a volume resistance value of the second area of each of the first electrode and the second electrode at the set temperature is denoted by A1 [Ω·m] and a volume resistance value of the heat generation resistive member at the set temperature is denoted by A2 [Ω·m], $A1 \leqq A2 \times S1 \times L2/(56.7 \times S2 \times L1)$ is satisfied.

6. An image heating apparatus according to any one of claims 1 to 2, wherein at least the second area of the first electrode and the second area of the second electrode are formed by a method other than sputtering and vapor-depositing.

7. A heater to be used in an image heating apparatus, comprising:

a substrate;

a heat generation resistive member formed on the substrate; and a first electrode and a second electrode for feeding power to the heat generation resistive member, wherein:

each of the first electrode and the second electrode includes a first area contacting with a feed power connector and a second area on an electrically opposite side of the first area;

the second area is disposed along a longitudinal direction of the substrate;

the heat generation resistive member is disposed so as to electrically connect the second area of the first electrode with the second area of the second electrode;

the heat generation resistive member is formed by sputtering or vapor-depositing, a part of the second area of the first electrode which is electrically closest to the first area is disposed on one end portion side in the longitudinal direction of the substrate;

a part of the second area of the second electrode electrically closest to the first area is disposed on another end portion side in the longitudinal direction of the substrate;

a length of the second area of each of the first electrode and the second electrode in the longitudinal direction of the substrate is denoted by L1 [m] and a cross-section of the second area cut along a short side direction of the substrate is denoted by S1 [$m^2$];

a length of the heat generation resistive member in the short side direction is denoted by L2 [m] and a cross-section of the heat generation resistive member cut along the longitudinal direction is denoted by S2 [$m^2$]; and a volume resistance value of the second area of each of the first electrode and the second electrode at a time of image heating processing is denoted by A1 [Ω·m] and a volume resistance value of the heat generation resistive member at the time of image heating processing is denoted by A2 [Ω·m], $A1 \leqq A2 \times S1 \times L2/(29.4 \times S2 \times L1)$ is satisfied.

8. A heater to be used in an image heating apparatus, comprising:

a substrate;

a heat generation resistive member formed on the substrate; and a first electrode and a second electrode for feeding power to the heat generation resistive member, wherein:

each of the first electrode and the second electrode includes a first area contacting with a feed power connector and a second area on an electrically opposite side of the first area;

the second area is disposed along a longitudinal direction of the substrate;

the heat generation resistive member is disposed so as to electrically connect the second area of the first electrode with the second area of the second electrode;

the heat generation resistive member is formed by sputtering or vapor-depositing, a part of the second area of the first electrode which is electrically closest to the first area and a part of the second area of the second electrode which is electrically closest to the first area are both disposed on one end portion side in the longitudinal direction of the substrate;

a length of the second area of each of the first electrode and the second electrode in the longitudinal direction of the substrate is denoted by L1 [m] and a cross-section of the second area cut along a short side direction of the substrate is denoted by S1 [$m^2$];

a length of the heat generation resistive member in the short side direction is denoted by L2 [m] and a cross-section of the heat generation resistive member cut along the longitudinal direction is denoted by S2 [$m^2$]; and a volume resistance value of the second area of each of the first electrode and the second electrode at a time of image heating processing is denoted by A1 [Ω·m] and a volume resistance value of the heat generation resistive member at the time of image heating processing is denoted by A2 [Ω·m], $A1 \leqq A2 \times S1 \times L2/(56.7 \times S2 \times L1)$ is satisfied.

9. A heater to be used in an image heating apparatus, comprising:

a substrate;

a heat generation resistive member formed on the substrate; and a first electrode and a second electrode for feeding power to the heat generation resistive member, wherein:

each of the first electrode and the second electrode includes a first area contacting with a feed power connector and a second area on an electrically opposite side of the first area;

the second area is disposed along a longitudinal direction of the substrate;

the heat generation resistive member is disposed so as to electrically connect the second area of the first electrode with the second area of the second electrode;

the heat generation resistive member is formed by sputtering or vapor-depositing, and a volume resistance value of the heat generation resistive member is equal to or smaller than 1.0E−5 [Ω·m].

10. A heater according to any one of claims 7 to 9, wherein at least the second area of the first electrode and the second area of the second electrode are formed by a method other than sputtering and vapor-deposition method.

11. A heater according to claim 10, wherein the at least the second area of the first electrode and the second area of the second electrode are formed by a screen printing method.

* * * * *